US009914132B2

(12) United States Patent
Coates et al.

(10) Patent No.: US 9,914,132 B2
(45) Date of Patent: Mar. 13, 2018

(54) DEVICES, SYSTEMS, AND METHODS FOR PROCESSING HETEROGENEOUS MATERIALS

(71) Applicants: Michael J. Pilgrim, Naples, FL (US); David H. Scriven, Casper, WY (US)

(72) Inventors: James A. Coates, Casper, WY (US); Charles Coates, Renton, WA (US); Eric Coates, Casper, WY (US); David H. Scriven, Casper, WY (US)

(73) Assignees: Michael J. Pilgrim, Naples, FL (US); David H. Scriven, Casper, WY (US)

( * ) Notice: Subject to any disclaimer, the term of this patent is extended or adjusted under 35 U.S.C. 154(b) by 1041 days.

(21) Appl. No.: 14/094,236

(22) Filed: Dec. 2, 2013

(65) Prior Publication Data

US 2014/0084088 A1 Mar. 27, 2014

Related U.S. Application Data

(63) Continuation-in-part of application No. 13/614,802, filed on Sep. 13, 2012, now Pat. No. 8,646,705.
(Continued)

(51) Int. Cl.
*B02C 23/10* (2006.01)
*B02C 23/06* (2006.01)
(Continued)

(52) U.S. Cl.
CPC ..... *B02C 23/10* (2013.01); *B02C 19/065* (2013.01); *B02C 23/06* (2013.01); *B02C 23/08* (2013.01)

(58) Field of Classification Search
CPC ..... B02C 19/06; B02C 19/061; B02C 19/063; B02C 19/065; B02C 19/066; B02C 19/068
See application file for complete search history.

(56) References Cited

U.S. PATENT DOCUMENTS 269,742 A 12/1882 Taggart
1,948,609 A 2/1934 Andrews et al.
(Continued)

FOREIGN PATENT DOCUMENTS

JP 2934229 B1 * 8/1999 ..... B02C 19/065
JP 11319618 A 11/1999
(Continued)

OTHER PUBLICATIONS

English translation of JP 2934229 (titled JPH11319618).*
(Continued)

*Primary Examiner* — Matthew G Katcoff
(74) *Attorney, Agent, or Firm* — TraskBritt

(57) ABSTRACT

A system for processing a heterogeneous material includes a conduit for a pressurized fluid and a nozzle assembly in fluid communication with the conduit. The nozzle assembly includes a plurality of adjustable nozzles configured such that fluid streams passing through each nozzle intersect at an oblique angle after passing through the nozzles. At least one of the fluid streams comprises a heterogeneous material. A method of processing a heterogeneous material includes entraining heterogeneous particles into at least one fluid stream, passing the fluid stream through an adjustable nozzle, impacting the fluid stream with another fluid stream at an oblique angle to ablate the heterogeneous particles, and classifying the heterogeneous particles.

21 Claims, 17 Drawing Sheets

Related U.S. Application Data

(60) Provisional application No. 61/535,253, filed on Sep. 15, 2011, provisional application No. 61/593,741, filed on Feb. 1, 2012.

(51) Int. Cl.
*B02C 23/08* (2006.01)
*B02C 19/06* (2006.01)

(56) References Cited

U.S. PATENT DOCUMENTS

| | | | | |
|---|---|---|---|---|
| 2,175,457 | A | 10/1939 | Dunn | |
| 2,562,024 | A | 7/1951 | Dunn et al. | |
| 2,766,496 | A | 10/1956 | Ward | |
| 2,846,150 | A | 8/1958 | Work | |
| 3,519,403 | A | 7/1970 | Vietzke et al. | |
| 3,559,895 | A | 2/1971 | Fay | |
| 3,876,156 | A | 4/1975 | Muschelknautz et al. | |
| 4,002,462 | A | 1/1977 | Maddox | |
| 4,283,015 | A | 8/1981 | Smith | |
| 4,569,696 | A | 2/1986 | Sandstrom et al. | |
| 4,861,349 | A | 8/1989 | Bublik et al. | |
| 4,940,187 | A | 7/1990 | Lee | |
| 5,346,532 | A | 9/1994 | Sinclair et al. | |
| 5,716,751 | A | 2/1998 | Bertrand et al. | |
| 5,732,893 | A * | 3/1998 | Nied | B02C 19/068 241/39 |
| 5,765,766 | A | 6/1998 | Yoshida et al. | |
| 6,082,640 | A | 7/2000 | Edlinger | |
| 6,138,931 | A * | 10/2000 | Geurts | B02C 19/065 241/40 |
| 6,691,938 | B2 | 2/2004 | Bradshaw | |
| 6,708,909 | B2 | 3/2004 | Toda et al. | |
| 6,712,215 | B2 | 3/2004 | Scheybeler | |
| 6,971,594 | B1 | 12/2005 | Polifka | |
| 7,278,595 | B2 * | 10/2007 | Itoh | B02C 23/02 241/39 |
| 7,416,671 | B2 | 8/2008 | Bozak et al. | |
| 2002/0054995 | A1 * | 5/2002 | Mazurkiewicz | B02C 19/06 428/364 |
| 2002/0182981 | A1 | 12/2002 | Bradshaw | |
| 2004/0016834 | A1 | 1/2004 | Casalmir et al. | |
| 2006/0032953 | A1 | 2/2006 | Kruse | |
| 2006/0086835 | A1 | 4/2006 | Nyssen et al. | |
| 2009/0314864 | A1 | 12/2009 | Kruse | |
| 2011/0009590 | A1 | 1/2011 | Matsumoto et al. | |
| 2013/0068863 | A1 | 3/2013 | Coates et al. | |

FOREIGN PATENT DOCUMENTS

| | | | |
|---|---|---|---|
| JP | 2002153769 | A | 5/2002 |
| JP | 2002320947 | A | 11/2002 |
| JP | 2006198530 | | 8/2006 |
| WO | 8501884 | | 5/1985 |

OTHER PUBLICATIONS

Australian Examination Report for Australian application No. 2014240222, dated Feb. 5, 2016, 5 pages.

International Preliminary Report on Patentability for International Application No. PCT/US2014/011529 dated Jun. 7, 2016, 10 pages.

International Search Report and Written Opinion for International Application No. PCT/US2014/011529, dated Sep. 1, 2014.

Extended European Search Report for European Patent Application No. 12832482.9, dated Jun. 9, 2015, 6 pages.

Harshman, E.N., "Geology and Uranium Deposits, Shirley Basin Area, Wyoming," Geological Survey Professional Paper 745, U.S. Govt. Printing Office, Washington, 1972, 91 pages.

Krumhansl et al., "Inherently Safe In Situ Uranium Recovery," Sandia Report, SAND2008-6688, Sandia National Laboratories, May 2009, pp. 1-18.

Lide, David R., Ed., "Hardness of Minerals and Ceramics," CRC Handbook of Chemistry and Physics, 81st Edition, CRC Press, 2000-2001, p. 12-211.

Merriam-Webster, definition of "homogeneous," located at http://www.merriam-webster.com/dictionary/homogeneous. Accessed on Jul. 25, 2013.

Merriam-Webster, definition of "heterogeneous," located at http://www.merriam-webster.com/dictionary/heterogeneous. Accessed on Jul. 25, 2013.

Merriam-Webster, definition of "Mineral," located at http://www.merriam-webster.com/dictionary/mineral. Accessed on Aug. 2, 2013.

Minerals Education Coalition, "If It Can't Be Grown, It must Be Mined," located at http://www.mineralseducationcoalition.org/minerals/mica. Accessed on Aug. 2, 2013.

PCT International Search Report and Written Opinion of the International Searching Authority for PCT/US2012/055157, dated Feb. 26, 2013, 9 pages.

Vine et al., "Geology and Uranium Occurrences in the Miller Hill Area Carbon County Wyoming," Geological Survey Bulletin 1074-F, U.S. Govt. Printing Office, Washington, 1959, 50 pages.

* cited by examiner

DEVICES, SYSTEMS, AND METHODS FOR PROCESSING HETEROGENEOUS MATERIALS

CROSS-REFERENCE TO RELATED APPLICATIONS

This application is a continuation-in-part application of U.S. patent application Ser. No. 13/614,802, filed Sep. 13, 2012, now U.S. Pat. No. 8,646,705, issued Feb. 11, 2014 which claims the benefit of U.S. Provisional Patent Application Ser. No. 61/535,253, filed Sep. 15, 2011, and entitled "Devices, Systems, and Methods for Processing Heterogeneous Materials" and U.S. Provisional Patent Application Ser. No. 61/593,741, filed Feb. 1, 2012, and entitled "Methods for Processing Heterogeneous Materials" the disclosures of each of which are incorporated herein in their entireties by this reference.

FIELD

The present disclosure relates generally to processing heterogeneous materials, such as ores or oil-contaminated sands, to separate the materials into discrete components.

BACKGROUND

Heterogeneous materials, such as heterogeneous solid materials, occur naturally and may also be formed by man-made processes. For example, naturally occurring ores may include volumes containing a material of interest (i.e., a so-called "bearing fraction"), such as a metal or a mineral, mixed with volumes not containing the material of interest (i.e., a so-called "non-bearing fraction"). Recovery of the material of interest generally requires physical or chemical separation of the bearing fraction from the non-bearing fraction. Chemical separation may require reagents (e.g., cyanide, acids, carbonates), which may be expensive or raise environmental challenges.

As one example of a heterogeneous material, uranium is typically found in nature as uranium ore. Low-grade uranium ore may contain any form of uranium-containing compounds in concentrations up to about 5 lbs of $U_3O_8$ equivalent per ton of ore (about 2.5 kg of $U_3O_8$ equivalent per 1000 kg of ore, or about 0.25% uranium oxides by weight), whereas higher grade ore may contain uranium-containing compounds in concentrations of about 8 lbs of $U_3O_8$ equivalent per ton of ore (about 4.0 kg of $U_3O_8$ equivalent per 1000 kg of ore, or about 0.4% uranium oxides by weight), about 30 lbs of $U_3O_8$ equivalent per ton of ore (about 15 kg of $U_3O_8$ equivalent per 1000 kg of ore, or about 1.5% uranium oxides by weight) or more.

Uranium deposits may be formed in sandstone by erosion and redeposition. For example, an uplift may raise a uranium-bearing source rock and expose the source rock to the atmosphere. The source rock may then erode, forming solutions of uranium and secondary minerals. The solutions may migrate along the surface of the earth or through permeable subsurface channels into a sandstone formation, stopping at a structural or chemical boundary. Uranium minerals may then be deposited as a patina or coating around or between grains of the formation. Uranium may also be present in carbonaceous materials within sandstone. Uranium may be all or a portion of the cementing material between grains of the formation.

FIG. 1 shows a section photomicrograph of sandstone formations from the Shirley Basin in central Wyoming. As shown in FIG. 1, uranium-bearing sandstone 10 may include various constituents. In general, oversize material 12 may be defined as relatively large particles or fragments, such as homogeneous particles of host rock. Oversize material 12 may also be defined as particles larger than can be processed in a particular processing system. For example, in some sandstone 10, oversize material 12 may include cobbles and stones arbitrarily defined as material having an average diameter larger than about 0.25 inch (in.) (6.35 mm). Oversize materials 12 in sandstone 10 generally do not contain much uranium. Grains 14 may generally be defined as particles or fragments smaller than oversize material 12. Grains 14 may include particles having diameters from about 400-mesh (i.e., about 0.0015 in. or about 0.037 mm) to about 0.25 in. (6.35 mm), and may include quartz or feldspar. Grains 14 in sandstone 10 do not typically contain much uranium, but uranium may be formed around the grains 14 due to deposition. Fines may be generally defined as particles disposed among the oversize material 12 and the grains 14, and may include materials also found in the grains 14 and oversized material 12, such as uranium, quartz, feldspar, etc. Fines may cement the oversize material 12 and the grains 14 into a solid mass. Fines in uranium-bearing sandstone 10 (e.g., particles smaller than about 400-mesh) may include light fines 16 and heavy fines 18. Light fines 16 generally have a specific gravity up to about 4.0 with reference to water, whereas heavy fines 18 have a specific gravity greater than about 4.0. Uranium compounds are generally components of the heavy fines 18, but may also be a part of light fines 16 in the form of deposits on carbonaceous materials. For example, uraninite has a specific gravity from about 6.5 to about 10.95, depending on its degree of oxidation, and coffinite has a specific gravity of about 5.4. Both light fines 16 and heavy fines 18 may be bound to grains 14 in the sandstone 10. In the sandstone 10, the oversize material 12, grains 14, light fines 16, and heavy fines 18 may be combined into a single mass.

Uranium may conventionally be recovered through in-situ recovery (ISR), also known in the art as in-situ leaching (ISL) or solution mining. In ISR, a leachate or lixiviant solution is pumped into an ore formation through a well. The solution permeates the formation and dissolves a portion of the ore. The solution is extracted through another well and processed to recover the uranium. Reagents used to dissolve uranium of the ore may include an acid or carbonate. ISR may have various environmental and operational concerns, such as mobilization of uranium or heavy metals into aquifers, footprint of surface operations, interconnection of wells, etc. ISR typically requires particular reagents, which must be supplied, recovered, and treated. Because ISR relies on the subsurface transport of a solution, ISR cannot generally be used in formations that are impermeable or shallow.

Uranium may also conventionally be mined in underground mines or surface mines (e.g., strip mines, open-pit mines, etc.). During such mining activities, it may be necessary to process large quantities of material having a concentration of uranium too low for economic recovery by conventional processes. Such material (e.g., overburden) may be treated as waste or as a material for use in mine reclamation. Conventional mining may produce significant amounts of such low-concentration material, which may require treatment during or subsequent to mining operations. It would therefore be advantageous to provide a method of uranium recovery that minimizes or alleviates these concerns.

SUMMARY

In some embodiments, a system for processing a heterogeneous material includes a conduit for a pressurized fluid and a nozzle assembly in fluid communication with the conduit. The nozzle assembly includes a plurality of adjustable nozzles configured such that fluid streams passing through each of the plurality of adjustable nozzles intersect at an oblique angle after passing through the plurality of adjustable nozzles. At least one of the fluid streams comprises a heterogeneous material.

In other embodiments, a system includes a conduit for a pressurized fluid, a nozzle assembly in fluid communication with the conduit, and a separation system configured to separate particles of a heterogeneous material into a first fraction and a second fraction. The nozzle assembly includes an adjustable nozzle configured such that a stream of the heterogeneous material passing through the adjustable nozzle contacts a surface approximately perpendicular to the surface after passing through the nozzle. The particles of the first fraction have a first average property, and the particles of the second fraction have a second average property different from the first average property.

In certain embodiments, a method of processing a heterogeneous material includes entraining heterogeneous particles of a material into at least one fluid stream, passing the fluid stream through an adjustable nozzle, impacting the fluid stream with another fluid stream at an oblique angle to ablate the heterogeneous particles of the material, and classifying the heterogeneous particles.

BRIEF DESCRIPTION OF THE DRAWINGS

While the specification concludes with claims particularly pointing out and distinctly claiming what are regarded as embodiments of the present disclosure, various features and advantages of embodiments of the present disclosure may be more readily ascertained from the following description of some embodiments of the present disclosure when read in conjunction with the accompanying drawings, in which:

DETAILED DESCRIPTION

Devices, systems, and methods for processing heterogeneous materials, such as heterogeneous solids, are described. In one embodiment, a method includes entraining heterogeneous particles into a fluid stream (e.g., air, water, oil, etc.). The fluid stream is passed through at least one nozzle of a system, and is impacted to ablate the heterogeneous particles via kinetic collisions between particles within the fluid stream. As used herein, the term "ablate" means and includes wearing away by flexure, rebound, and distortion. Ablation may also include wear by friction, chipping, spalling, or another erosive process. When particles are ablated, the boundary between different materials may become more highly stressed than the bulk materials themselves. Thus, ablation may be particularly applicable to physical removal of coatings from an underlying material. Ablation imparts energy to the material being ablated to physically dissociate the material into various fractions (e.g., a solid fraction and an oil or two solid fractions). The ablated particles may then be classified to divide the heterogeneous material into various fractions. Ablation and separation may significantly reduce the amount of material to be further processed to recover the one or more desired components of the material. A system for the ablation process may include a conduit for a pressurized fluid and a nozzle assembly. The nozzle assembly may include two or more adjustable nozzles configured such that a stream passing through a nozzle intersects another stream passing through another nozzle in the nozzle assembly. The method and system may be scalable for operations of any size. The system may be portable, and its use may make separation commercially feasible in instances wherein conventional separation processes are impractical.

The devices, systems, and methods described herein may be particularly applicable to ores, such as sandstone, for the recovery of selected minerals, such as uranium-containing compounds. Uranium is often a post-depositional material, carried into an already established sandstone formation by mineral-bearing solutions. Without being bound to any particular theory, it is believed that when these mineral-bearing solutions reached a reduction zone, carbon caused the uranium to reduce and precipitate out of solution to form stable uranium-containing compounds. Because the sandstone formation was already in place, these uranium-containing compounds formed in two very specific locations within the ore—as a mineral patina surrounding grains and in carbonaceous material. Because the grain structure of sandstone is relatively impermeable, uranium patinas do not penetrate the grains. Instead, uranium patinas form a boundary between the grain and the cementing material in the sandstone formation.

Figure 1:
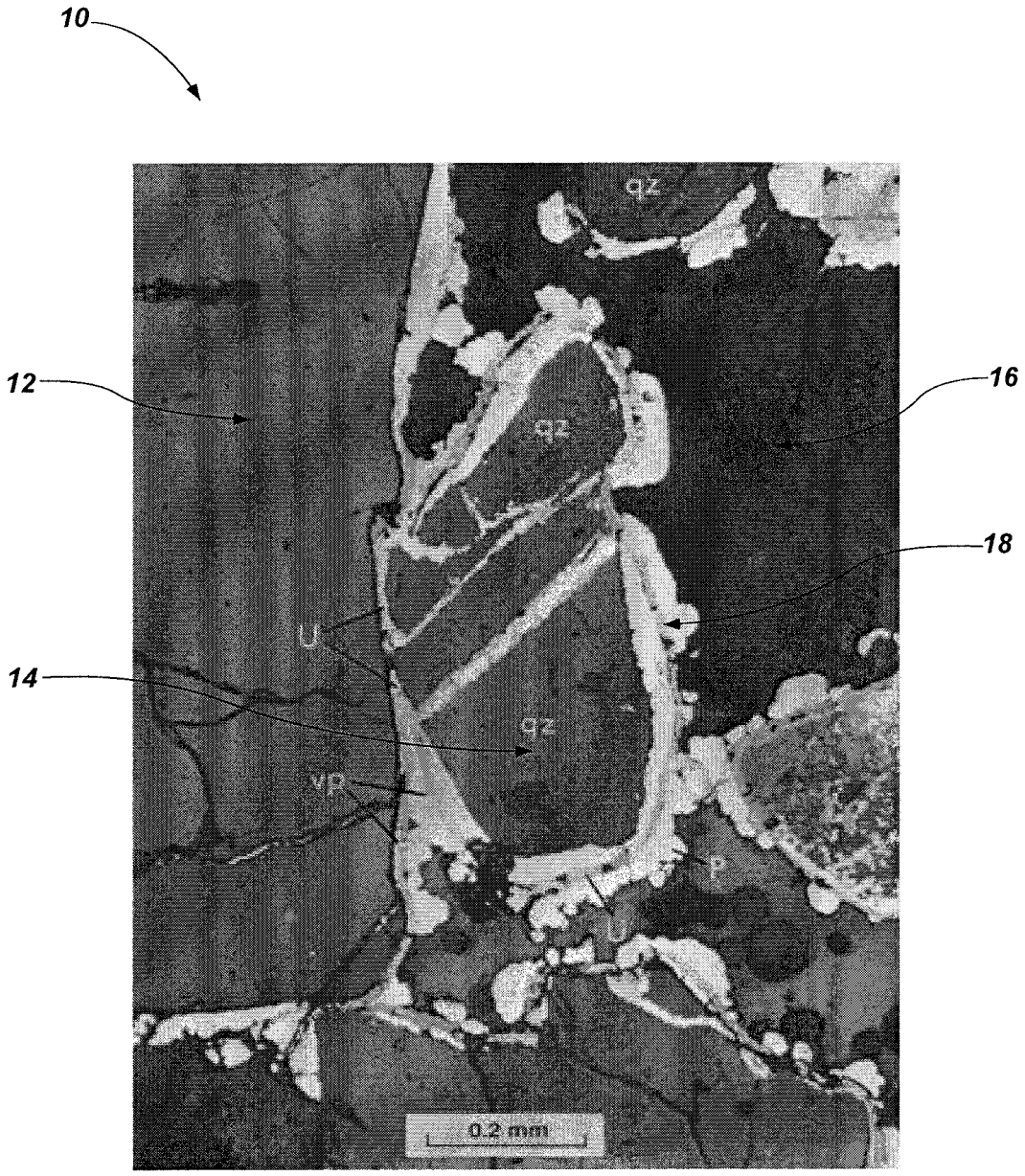
FIG. 1 (PRIOR ART)
FIG. 1 is a photomicrograph of uranium ore in a sandstone formation.
Figure 2:
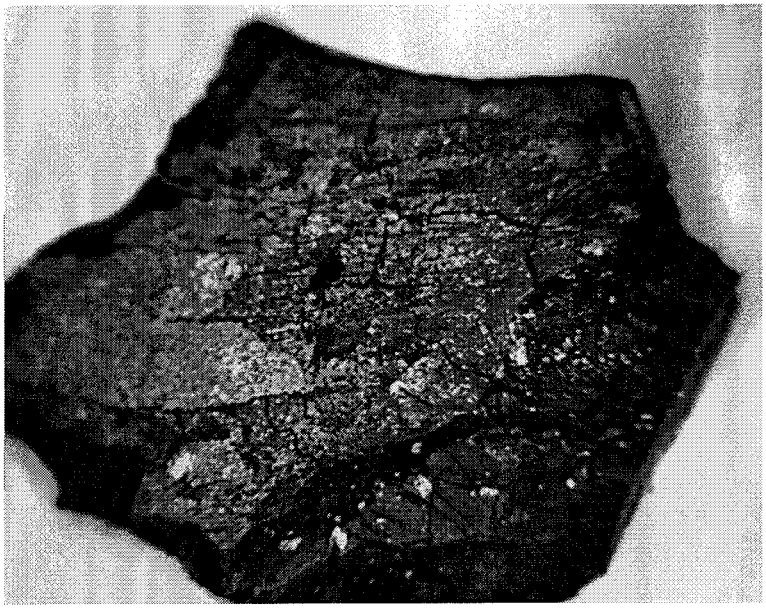
FIG. 2 is a photomicrograph of a carbonaceous material.

As shown in FIG. 1, the uranium mineral patina includes the heavy fines 18, and is shown around quartz grains 14. Carbonaceous materials are commonly found in sandstone-hosted uranium deposits, such as in the light fines 16 shown in FIG. 1. In sandstone-hosted uranium deposits, carbonaceous materials generally range in size from less than about 1 mm to more than about 25 mm across. Other carbonaceous materials include partially decomposed trees, coal seams, etc., and vary widely in size. FIG. 2 shows a sample of a carbonaceous material. Carbonaceous materials generally have low specific gravities of between about 1.25 and 1.30, and may contain high concentrations of uranium or other post-depositional elements deposited by permeation of mineral-bearing solutions. However, carbonaceous materials may also have specific gravities higher or lower, depending on how the carbonaceous materials formed. For example, some carbonaceous materials may have specific gravities less than about 1.0. Carbonaceous materials subjected to compressive forces may have specific gravities greater than about 1.5. Dissociating and then recovering the light fines 16 from the oversize material 12, the grains 14, and the heavy fines 18 may therefore enable enhanced recovery of certain elements without processing the entire mass of sandstone by conventional techniques.

The properties of both the heavy fines 18 (including the mineralized uranium patina) and the light fines 16 (including the carbonaceous materials) makes them each amenable to dissociation and separation from the oversize material 12, which does not contain uranium, and grains 14 of sandstone using an ablation process of the present disclosure. During ablation, the heavy fines 18 are separated from the oversize material 12 and grains 14. Without the structure of the oversize material 12 and grains 14, the patina has limited structure and forms the heavy fines 18, which are smaller than about 400-mesh. That is, the patina forms weak bonds between particles such that ablation breaks the patina particles down into particles smaller than about 400-mesh.

Some illustrations presented herein are not actual views of a particular system or process, but are merely idealized representations employed to describe embodiments of the present disclosure. Elements common between figures may retain the same numerical designation.

Figure 3:
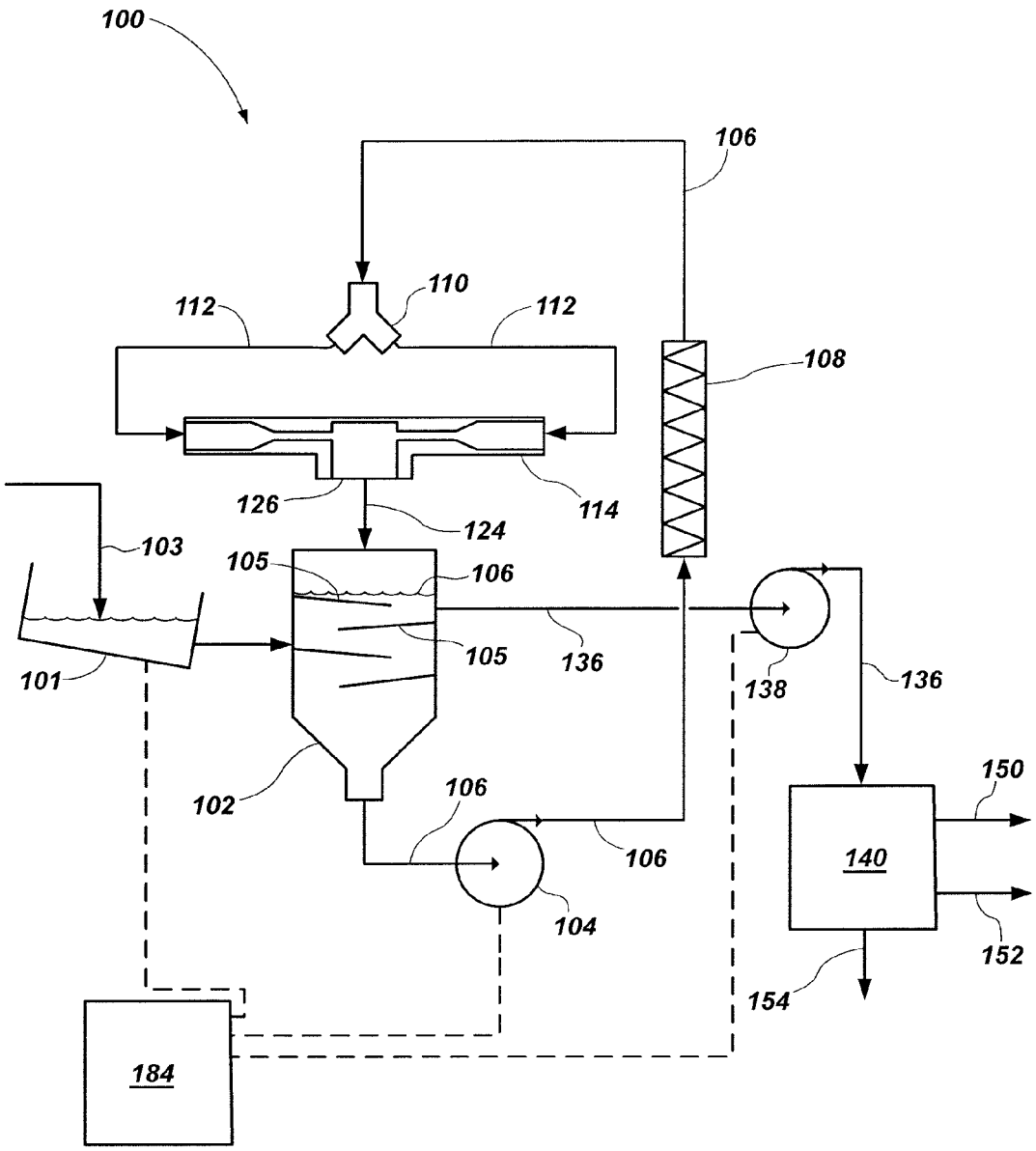
FIG. 3 is a simplified schematic illustrating an embodiment of a system for processing a heterogeneous material.

A system 100 for processing a heterogeneous material 103 is shown schematically in FIG. 3. To simplify the figures and clarify the present disclosure, not every element or component of the system 100 is shown or described herein. The system 100 may also include appropriate piping, connectors, sensors, controllers, etc. (not shown), as will be understood by those of ordinary skill in the art. The system 100 may include a hopper 101 feeding a tank 102, and a pump 104 in fluid communication with the tank 102. The pump 104 may transport a mixed heterogeneous material 106 (which may include a mixture of the heterogeneous material 103 from the hopper 101 and an ablated heterogeneous material 124 that is recycled through a portion of the system 100, as explained in more detail below) through a continuous-flow mixing device 108 and a splitter 110. The mixed heterogeneous material 106 may then pass through a nozzle assembly 114, and multiple streams of the mixed heterogeneous material 106 may impact one another, ablating solid particles therein to form the ablated heterogeneous material 124. The ablated heterogeneous material 124 may, in some embodiments, be recycled through the system 100 by mixing the ablated heterogeneous material 124 with the unablated heterogeneous material 103 in the tank 102. A stream 136 may be drawn off through a pump 138 to a separation system 140, where it may be separated into two or more components. For example, in the system 100, the separation system 140 may separate the stream 136 into grains 150, light fines 152, and heavy fines 154. Though shown as a continuous-flow operation, the system 100 may also be configured to operate in batch mode, as will be understood by a person having ordinary skill in the art. Similarly, the system 100 may include multiple pumps, mixing apparatuses, and/or nozzle assemblies operated in series, such as with the stream 136 being directed through a second nozzle assembly before entering the separation system 140. A system 100 having multiple nozzle assemblies operating in series may be configured such that each and every particle of the heterogeneous material 103 necessarily passes through each nozzle assembly at least once. In embodiments in which the system 100 includes multiple nozzle assemblies operating in series, subsequent nozzle assemblies may operate without additional hoppers 101 or separation systems 140.

In some embodiments, the heterogeneous material 103 may be placed into the hopper 101. The heterogeneous material 103 may include solid particles or a mixture of solid particles with a liquid. For example, the heterogeneous material 103 may include a portion of an ore containing a metal (e.g., uranium, gold, copper, and/or a rare-earth element) to be recovered. In some embodiments, the heterogeneous material 103 may be oil-contaminated sand. The liquid may include water (e.g., groundwater, process water, culinary or municipal water, distilled water, deionized water, etc.), an acid, a base, an organic solvent, a surfactant, a salt, or any combination thereof. The liquid may include dissolved materials, such as a carbonate or oxygen. In some embodiments, the liquid may be substantially pure water, or water removed from a water source (e.g., an underground aquifer) without purification and without added components. The composition of the liquid may be selected to balance economic, environmental, and processing concerns (e.g., mineral solubility or disposal). The liquid may be selected to comply with environmental regulations. In one embodiment, the liquid may be substantially free of a reagent (e.g., a leachate, an acid, an alkali, cyanide, lead nitrate, etc.) that is formulated to chemically react with the particles in the heterogeneous material 103. In some embodiments, the liquid may be omitted. The hopper 101 may be configured to feed the heterogeneous material 103 into the tank 102. For example, the hopper 101 may be placed at a higher elevation than the tank 102, such that the heterogeneous material 103 flows by gravity into the tank 102. The hopper 101 may include a device to move the heterogeneous material 103 to the tank 102, such as an auger, tilt table, etc., which may communicate with or be controlled by a computer 184, such as a programmable logic controller (PLC). The computer 184 may detect operating conditions of the system 100 via one or more sensors (not shown) and adjust the flow of the heterogeneous material 103 accordingly.

The tank 102 may have an inlet (not shown) configured to receive the heterogeneous material 103 from the hopper 101. The tank 102 may have one or more angled baffles 105 configured to direct the flow of the heterogeneous material 103. In a continuous-flow system, the heterogeneous material 103 may mix with a mixed heterogeneous material 106 already in the tank 102. The tank 102 may optionally have an input port (not shown) to add liquid to the mixed heterogeneous material 106. The tank 102 may include a volume that narrows toward the ground, such as a conical portion. The narrowed volume may direct solids of the mixed heterogeneous material 106 into an outlet at the bottom of the tank 102.

The pump 104 may be in fluid communication with the tank 102, and may draw the mixed heterogeneous material 106 from the outlet of the tank 102. The pump 104 may be a horizontal centrifugal pump, an axial centrifugal pump, a vertical centrifugal pump, or any other pump configured to pressurize and transport the mixed heterogeneous material 106. The pump 104 may be selected such that solid particles of the mixed heterogeneous material 106 may pass through the pump 104 at an appropriate flow rate without damaging the pump 104. For example, the pump 104 may be selected to pump 30 gallons per minute (gpm) (1.9 liters per second (Vs) of a mixed heterogeneous material 106 containing particles up to about 0.25 in. (6.35 mm) in diameter at a pressure of 32 pounds per square inch (psi) (221 kilopascals (kPa)). For example, the pump 104 may be a 5-horsepower WARMAN® Series 1000 pump, available from Weir Minerals, of Madison, Wis. The pump 104 may deliver any selected pressure and flow rate, and may be selected by a person having ordinary skill in the art based on the requirements for a particular application (e.g., a selected heterogeneous material 103 feedstock composition and flow rate). The pump 104 may communicate with or be controlled by the computer 184. The computer 184 may detect operating conditions of the system 100 (e.g., by sensors (not shown)) and adjust the operation of the pump 104. In some embodiments, the system 100 may include multiple pumps 104 (not shown in FIG. 3).

The pump 104 may pressurize and transport the mixed heterogeneous material 106 through a continuous-flow mixing device 108, such as a pipe having mixing vanes inside. The continuous-flow mixing device 108 may promote a uniform distribution of the solid particles within the mixed heterogeneous material 106. For example, mixing vanes may cause larger or more dense particles (which may tend to be distributed differently in the mixed heterogeneous material 106 than fines) to be remixed throughout the mixed heterogeneous material 106. The mixed heterogeneous material 106 may pass through a splitter 110, separating the mixed heterogeneous material 106 into a plurality of streams 112 approximately equal in volumetric flow and composition. For example, the splitter 110 may produce two, three, four, or more streams 112. In some embodiments, a rotor of the pump 104 may be aligned with respect to the splitter 110 such that each stream 112 includes identical or nearly identical amounts of solid particles of each size and/or density. For example, a plane of symmetry of the splitter 110 may be perpendicular to an axis of rotation of the rotor of the pump 104. In such embodiments, the continuous-flow mixing device 108 may be omitted, saving energy that would otherwise be used for mixing in the continuous-flow mixing device 108. In embodiments having multiple pumps 104 (not shown in FIG. 3), the mixed heterogeneous material 106 may be separated into components without a continuous-flow mixing device 108. Each stream 112 may pass through various piping or hoses, and such piping or hoses may be configured to have the same dimensions. For example, the length and curvature of the piping for each stream 112 may be equivalent and arranged symmetrically, such that each stream 112 experiences equivalent energy loss in the piping.

Figure 4:
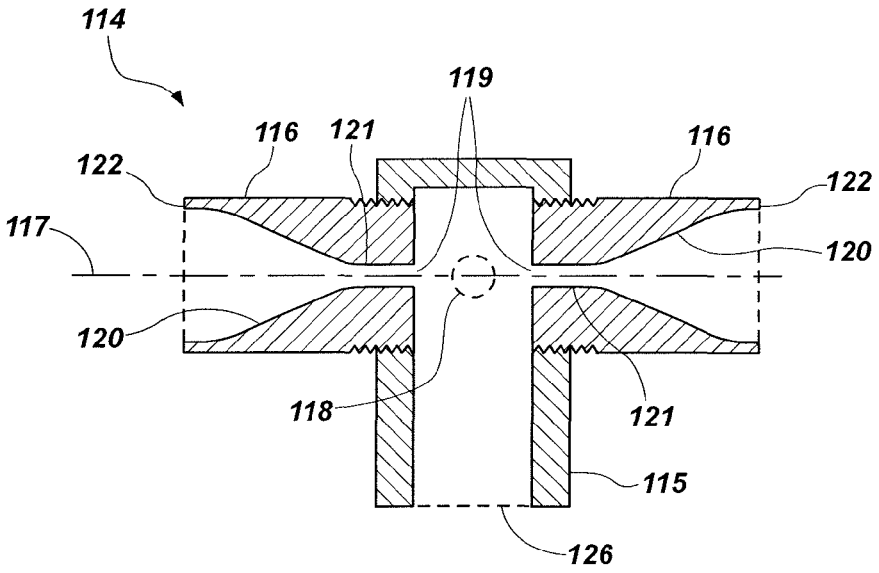
FIG. 4 is an enlarged cross-sectional view of a nozzle assembly as shown in the system of FIG. 3.

The streams 112 produced by the splitter 110 or from the multiple pumps 104 (not shown in FIG. 3) may enter a nozzle assembly 114, shown in simplified cross-sectional view in FIG. 4, through a plurality of inlets 122. At the point of entry to the nozzle assembly 114, the streams 112 may each have the same amount of kinetic energy. The nozzle assembly 114 may include a body 115 and a plurality of nozzles 116 arranged and configured such that the streams 112 (not depicted in FIG. 4) intersect in an impact zone 118, indicated by a dashed circle in FIG. 4, after passing through the nozzles 116. The streams 112 may intersect in an open portion of the nozzle assembly 114. The nozzles 116 may form the streams 112 into coherent, focused streams. The nozzle assembly 114 may have a plurality of flow constriction zones 120 between inlets 122 and the nozzles 116 in which the flow velocity of the streams 112 increases. The flow constriction zones 120 may have sizes and shapes such that the streams 112 flow through the nozzles 116 without cavitation. The flow constriction zones 120 may have a size and shape configured to increase the flow velocity of the streams 112 isentropically (i.e., with little or no increase in entropy), such as by a reversible adiabatic compression. The flow constriction zones 120 may reduce the area through which the streams 112 pass. Each nozzle 116 may have a plurality of straight sections 121 (e.g., collimating tubes) having one or more walls approximately parallel to an axis of symmetry 117 between the flow constriction zones 120 and the nozzle exits 119. The straight sections 121 may serve to collimate or align the flow of particles and fluid of the streams 112 so that the particles travel in directions approximately parallel. Longer straight sections 121 may be more effective at aligning the flow than shorter straight sections 121. In some embodiments, the cross-sectional area of the straight sections 121 may be approximately the same as the cross-sectional area of the nozzle exits 119, and may be from about 5% to about 20% of the cross-sectional area of the inlets 122. In other embodiments, the cross-sectional area of the nozzle exits 119 may be approximately equal to the cross-sectional area of the inlets 122, which may, in turn, be approximately equal to the cross section of an outlet of the pump(s) 104. The diameter of the nozzle exits 119 may be selected to be approximately twice the diameter of the largest particles expected to pass through the nozzles 116. The velocity of the streams 112 may vary in proportion to an inverse of the cross-sectional area, and the velocity of the streams 112 at the nozzle exits 119 may therefore be from about 5 times to about 20 times the velocity of streams 112 at the inlets 122. The velocity of the streams 112 may be tailored for a specific application. For example, the velocity of the streams 112 may be from about 10 feet per second (ft/s) (3.0 meters per second (m/s)) to about 1000 ft/s (305 m/s). The velocity of the streams 112 may depend on the properties of the heterogeneous material 103 (FIG. 3). For example, in some applications, the velocity of the streams 112 may be from about 300 ft/s (91 m/s) to about 500 ft/s (152 m/s), whereas in other applications, the velocity of the streams 112 may be from about 40 ft/s (12.2 m/s) to about 60 ft/s (18.3 m/s). The velocity of the streams 112 may be selected such that solids are carried along with liquids in the heterogeneous material 106 and that enough energy is transferred to particles to dissociate constituents of the particles without breaking homogeneous portions of particles (e.g., to remove a coating without breaking a core over which a coating is disposed). In some embodiments, the velocity of the streams may be selected (i.e., relatively higher) such that enough energy is transferred to particles to pulverize homogeneous portions of material into finer particles. Thus, the ablated heterogeneous material 124 (FIG. 3) may optionally include particles having a relatively uniform particle size. Each of the nozzles 116 may have its own axis of symmetry 117 in the center thereof. The axis of symmetry 117 of one nozzle 116 may intersect or coincide with the axis of symmetry 117 of another nozzle 116 in the impact zone 118. In embodiments in which the nozzle assembly 114 contains two nozzles 116, the nozzles 116 may share a single axis of symmetry 117. Furthermore, the nozzles 116 may be oriented to face one another. That is, two streams 112 may impact one another traveling in opposite directions (i.e., head-on) through counter-opposing nozzles 116. In such an arrangement, the kinetic energy of the streams 112 converted to impact energy may be larger than in nozzle arrangements in which the streams impact obliquely or perpendicularly.

Figure 5:
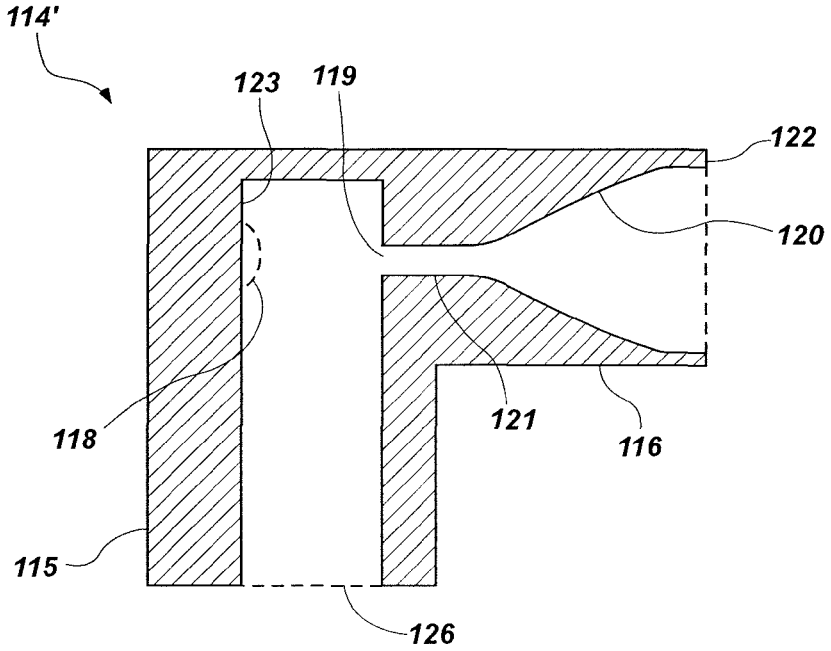
FIGS. 5 and 6 are enlarged cross-sectional views of nozzle assemblies of additional embodiments of the present disclosure.

FIG. 5 illustrates another embodiment of a nozzle assembly 114'. A system 100 having nozzle the assembly 114' may not include a splitter 110, but may instead be configured such that the entire mixed heterogeneous material 106 is directed through a single nozzle 116. The nozzle 116 may be configured to direct the stream 112 (not depicted in FIG. 5) against a solid object, such as surface 123 of the impact zone 118. The portion of the surface 123 against which the stream 112 collides may be the impact zone 118 of the nozzle assembly 114'. In the nozzle assembly 114' of FIG. 5, the body 115 and nozzle 116 may be a single unitary structure.

Figure 6:
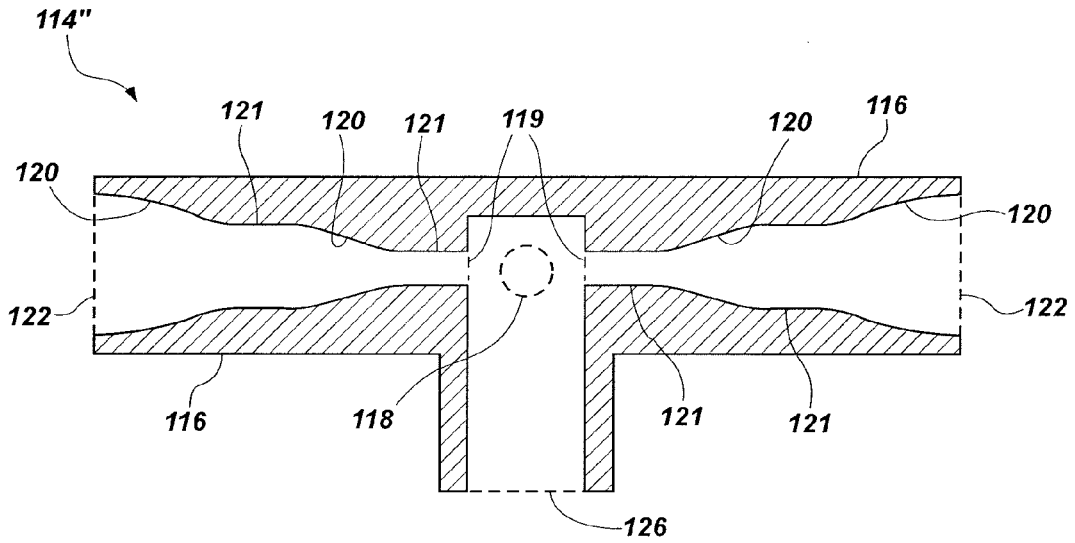

FIG. 6 illustrates another embodiment of a nozzle assembly 114". Each stream 112 (not depicted in FIG. 6) may pass through multiple constriction zones 120 separated by straight sections 121 before exiting a corresponding nozzle 116. Two constriction zones 120 are shown for each nozzle 116 in the nozzle assembly 114" shown in FIG. 6, but a nozzle assembly 114" may include any number of constriction zones 120. Multiple constriction zones 120 and multiple straight sections 121 may contribute to increased collimation and decreased wear of the nozzle assembly 114". Thus, additional constriction zones 120 may increase the efficiency of the system 100.

The impact zone 118 may be centrally positioned proximate to the nozzles 116 (e.g., between or among multiple nozzles 116, or on a surface across a gap from a single nozzle 116). In embodiments having two nozzles 116, the impact zone 118 may be located approximately midway between the two nozzles 116 (i.e., if the streams 112 have equivalent mass flow and particle distribution), but may be located anywhere between the two nozzles 116 or in any location in which the streams 112 can intersect. The size of the impact zone 118 may be determined by various design parameters, such as the velocity of the mixed heterogeneous material 106, the size and/or shape of the nozzles 116, the roughness of the material of the nozzle assembly 114, the alignment of the nozzles 116, the number of nozzles 116, the distance between the nozzles 116 (if applicable), the length and/or number of the straight sections 121, the composition of the streams 112, etc. The impact zone 118 may encompass the vena contracta of each stream 112 (i.e., the point at which the diameter of each stream 112 is at a minimum, and the velocity of each stream 112 is at a maximum). The volume or area of the impact zone 118 may correspond to the concentration of energy of the streams 112. That is, in the collision of tightly focused streams 112, particles may be more likely to impact or collide directly with other particles traveling in an opposite direction than they are in streams 112 intersecting in a larger volume. The particles have a greater probability of colliding directly if the streams 112 themselves impact directly (e.g., one stream is positioned at an angle of about 180° relative to another, opposing stream) or nearly directly (e.g., one stream is positioned at an oblique angle relative to another, opposing stream). For example, one stream may be positioned between about 45° and about 180° (e.g., near 180°) relative to another, opposing stream. Likewise, in the collision of a tightly focused stream with a surface 123, particles may be more likely to collide with the surface 123 perpendicularly than they are in a stream 112 tangentially intersecting a larger area of the surface. To control the volume or area of the impact zone 118, it may be desirable to limit or prevent flaring of the streams 112 as the streams 112 leave the nozzles 116. Flaring may be reduced or eliminated by, for example, lengthening the straight section 121, precision machining, reducing surface roughness, including a shielding fluid (e.g., air, water, oil, etc.) around the stream 112, etc.

The kinetic energy of the streams 112 may be used to separate materials of the particles in the streams 112, such as coatings or layers of material overlying a core (e.g., a film, patina, varnish, oxide, or crust). For example, if the mixed heterogeneous material 106 (and therefore, each of the streams 112) contains uranium ore, including particles of the sandstone 10 shown in FIG. 1, the kinetic energy of the streams 112 may remove the light fines 16 and/or the heavy fines 18 from the grains 14. If the mixed heterogeneous material 106 contains micro-fine gold particles having silicate patinas, the kinetic energy may remove the silicate from the gold. If the mixed heterogeneous material 106 contains oil-contaminated sand, the kinetic energy may remove the oil coating from the grains of sand. Separation of materials may be a physical process (e.g., physical dissociation), independent of any chemical process (e.g., chemical reaction, dissolution) of any materials. Thus, by utilizing embodiments of the present disclosure, materials may be separated without the addition of reagents (e.g., leachates, acids, alkalis, cyanide, lead nitrate, etc.), and the system 100 may be used to recover materials that are conventionally recovered by environmentally or operationally problematic techniques. However, reagents may be present in the liquid, such as in the groundwater, in trace amounts. Thus, embodiments of the present disclosure may be used to separate materials from one another even when none of the materials has sufficient solubility in the liquid for chemical separation. In other embodiments, reagents may nonetheless be added to enhance dissolution of certain species. For example, sodium bicarbonate may be added to the streams 112 to promote the dissolution of uranium in conjunction with the energy input within the system 100.

The nozzle assembly 114 may be customized or tuned for various applications. For example, the distance from the nozzles 116 to the impact zone 118 may be varied, such as by moving the nozzles 116 inward or outward in the nozzle assembly 114. The nozzles 116 may be adjustable, including threaded fittings or other means to adjust the position and/or orientation of the nozzles 116 with respect to the impact zone 118 (e.g., to move the vena contracta within the impact zone 118, to move the impact zone 118 such that the streams 112 of material leaving the nozzles 116 do not travel along the same line, etc.). Other properties of the system 100 that may be adjusted include, for example, nozzle diameter, the number of nozzles, the length and/or number of constriction zones 120 and straight sections 121, the addition of a liquid to the mixed heterogeneous material 106, the maximum particles size of the heterogeneous material 103 entering the system 100, etc. Performance may also be adjusted by changing the pressure, velocity, and/or composition of the streams 112 exiting the nozzles 116. Some properties may be made by, for example, adjusting the power output of the pump 104. Such tuning may be desirable to use the system 100 to process different materials. As another example, one fluid may be passed through one nozzle, and another fluid may be passed through another nozzle. In such embodiments, one or both fluids may carry particles of the mixed heterogeneous material 106. In some embodiments, tuning may be performed in the field, such that as changes are encountered in a feed stream of heterogeneous material 103, adjustments may be made to maintain or improve processing efficiency.

In some embodiments, it may be desirable to impact particles with a lower energy, such as when a bond between two materials to be dissociated is relatively low. The impact energy may be lowered by adjusting one or more properties as described above. The impact energy may also be lowered by colliding the streams 112 in a configuration other than directly opposing. Two streams 112 may be aligned such that they intersect at an angle less than 180°, such as in the shape of the letter "V." Such an arrangement may also direct the flow of the material after impact.

Figure 25:
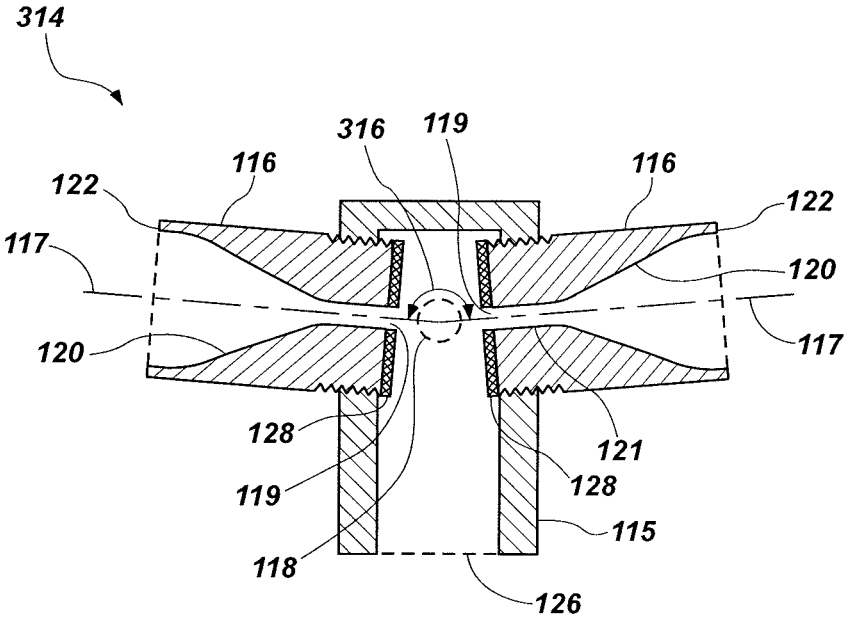
FIG. 25 is a cross-sectional view of a nozzle assembly of an additional embodiment of the present disclosure.

For example, FIG. 25 is a cross-sectional view of a nozzle assembly 314 in which axes of symmetry 117 intersect at an oblique angle, such that the streams 112 (not shown in FIG. 25) passing through the nozzles 116 impact at an oblique angle (e.g., the axes of symmetry 117 of the nozzles 116 do not fall on the same line). As shown in FIG. 25, the nozzle exits 119 and the impact zone 118 may not be collinear. For example, the streams 112 may impact at an angle 316 ranging from about 90° to less than about 180°. It may be beneficial to select the angle 316 to be near 180°, such that most of the kinetic energy of the streams 112 is converted to impact energy. For example, the angle 316 may range from about 160° to about 179.9°, from about 170° to about 179°, or about 175°. Though impacting the streams 112 at an oblique angle may result in relatively lower impact energy than a head-on impact, the oblique angle may have other benefits. For example, it has been observed that in nozzles 116 oriented directly head-on, such as those shown in FIG. 4, or a nozzle assembly having another configuration including an even number of nozzles, small perturbations in the flow of the streams 112 may cause the flow through one or more of the nozzles 116 to stop or clog the nozzles 116, an effect that has not been observed in nozzle assemblies 314 in which the nozzles 116 are oriented obliquely to one another. Without being bound to any particular theory, it is believed that in embodiments in which the streams 112 impact each other directly head-on, a perturbation in the flow of the streams 112 causes a shift in the location of the impact zone 118. Due to Bernoulli's principle, the pressure in the impact zone 118 is higher than the pressure in the streams 112 within the nozzles 116. A change in flow velocity or pressure of one stream 112 relative to another stream 112, such that the streams 112 are not balanced, may cause the impact zone 118 to shift. If the impact zone 118 shifts near one of the nozzles, the flow through that nozzle 116 can stop almost instantaneously, because the pressure at the impact zone 118 is greater than the pressure of the stream 112 in the nozzle 116. When this occurs, flow through the system 100 may be restarted by stopping and restarting the pump 104. However, in embodiments in which the streams 112 impact at an oblique angle, such as in the nozzle assembly 314 shown in FIG. 25, a perturbation in the flow of one of the streams 112 may cause movement of the impact zone 118, but does not generally cause flow through any nozzle 116 to stop.

Wear on the exterior surface of the nozzles 116 or on the interior of the straight sections 121 (e.g., collimating tubes) may alter the nozzle geometry and change the efficiency of the ablation process. In some embodiments, a non-brittle hard material 128 may be disposed over at least one surface of the nozzles 116 to protect the nozzles 116, and particularly the straight sections 121, from wear. For example, the non-brittle hard material 128 may be a high-yield-strength metal that is resistant to abrasion (e.g., tungsten or hardened steel), a non-brittle ceramic, a diamond-impregnated ceramic, a hardfacing material, or any other material. The non-brittle hard material 128 may be in the form of a washer, a surface coating, a bonded plate, etc. The non-brittle hard material 128 may be secured to nozzles 116 by an adhesive, a weld, fasteners (e.g., screws), or any other means or combination. In some embodiments, the non-brittle hard material 128 includes a tungsten washer bonded to the nozzle 116 with epoxy.

Figure 26:
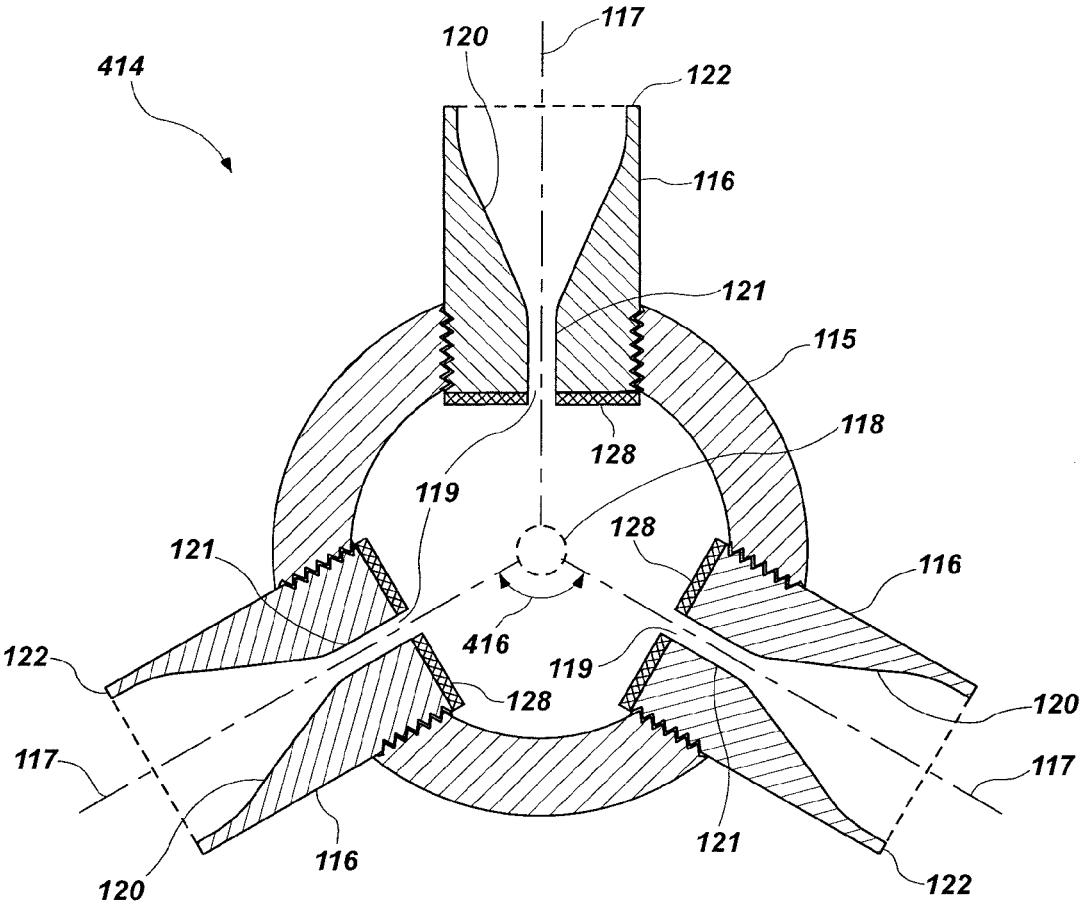
FIG. 26 is a cross-sectional top view of a nozzle assembly of another embodiment of the present disclosure.

FIG. 26 illustrates a cross-sectional top view of another embodiment of a nozzle assembly 414. The nozzle assembly 414 includes three nozzles 116, rather than two. In this nozzle assembly 414, a shift in the location of the impact zone 118 is unlikely to cause flow through any nozzle 116 to stop because none of the nozzles 116 directly opposes any other nozzle 116. Some such nozzle assemblies 414 may include any odd number of nozzles 116, such as five nozzles 116, seven nozzles 116, etc. The splitter 110 (FIG. 3) produces the same number of streams 112 as there are nozzles 116. Like the streams 112 that pass through the nozzles 116 shown in FIG. 25, the streams 112 (not shown in FIG. 26) that pass through the nozzles 116 in the nozzle assembly 414 shown in FIG. 26 intersect at an oblique angle 416. In the nozzle assembly 414 having three nozzles 116, the streams 112 intersect at an angle 416 of about 120°. In a nozzle assembly having five nozzles 116, streams 112 intersect at an angle of about 72°. In a nozzle assembly having seven nozzles 116, streams 112 intersect at an angle of about 51.4°.

After intersection of the streams 112 of the mixed heterogeneous material 106 in the impact zone 118, the streams 112 may recombine into a single stream of ablated heterogeneous material 124, and may flow through an outlet 126 of the nozzle assembly 114. The ablated heterogeneous material 124 may contain more particles and/or finer particles than the mixed heterogeneous material 106 entering the nozzle assembly 114. The outlet 126 may have a cross-sectional area larger than the combined cross-sectional areas of the nozzles 116, such that the flow of the ablated heterogeneous material 124 does not fill the entire outlet 126. Air may, therefore, flow freely into or out of the outlet 126 adjacent the impact zone 118. In some embodiments, the tank 102 (FIG. 3) may be sealed from ambient air, and may be filled with a gas. For example, the tank 102 may contain an inert gas. In such embodiments, the inert gas may flow freely into or out of the outlet 126. The outlet 126 may be disposed below the impact zone 118, such that the stream of ablated heterogeneous material 124 exits the nozzle assembly 114 by the force of gravity. For example, if the nozzle assembly 114 (or, alternatively, nozzle assembly 114" (FIG. 6) or 314 (FIG. 25)) has two nozzles 116, the nozzle assembly 114 may be shaped like the letter "T," with the two nozzles 116 pointed at each other, and wherein the outlet 126 is below the impact zone 118 between the nozzles 116. In embodiments in which the streams 112 include a slurry, the nozzle assembly 114 (or nozzle assembly 114' (FIG. 5), 114" (FIG. 6), 314 (FIG. 25), or 414 (FIG. 26)) may have air disposed therein, such that the streams 112 flow through air after leaving the nozzles 116 and before reaching the impact zone 118.

Referring again to FIG. 3, the stream of ablated heterogeneous material 124 may pass through the outlet 126 of the nozzle assembly 114 back to the tank 102, and may mix with the mixed heterogeneous material 106 in the tank 102. A discharge pump 138 may extract a stream 136 of the mixed heterogeneous material 106 from the tank 102 and may transfer the stream 136 to a separation system 140. For example, the stream 136 may be drawn from an outlet located above one or more baffles 105, and the heterogeneous material 103 may enter the tank 102 below one or more of the baffles 105. The baffles 105 may direct the flow of the ablated heterogeneous material 124 past the outlet for the stream 136 before mixing the heterogeneous material 103 from the hopper 101, such that material of the stream 136 is drawn from the ablated heterogeneous material 124 that has been passed through the nozzle assembly 114 at least once. In some embodiments, and as discussed above, the system 100 may include multiple nozzle assemblies 114 operated in series, such that material of the stream 136 passing to the separation system 140 has passed through each nozzle assembly 114 at least once. In such embodiments, the system 100 may include one or more transfer pumps to transfer material from one nozzle assembly 114 to another. The flow rate of the stream 136 may be varied relative to other flow rates (e.g., the flow rate of the heterogeneous material 103 into the tank 102 or the flow rate of the mixed heterogeneous material 106 through the pump 104) to adjust the average number of times that particles pass through the system 100. Different heterogeneous materials 103 may have different bonding properties, and therefore may require different amounts of energy to effect dissociation. For example, relatively weaker bonds may be broken by relatively less-direct collisions in the impact zone 118 (see FIGS. 4 through 6), whereas relatively stronger bonds may require more-direct collisions. To increase the fraction of particles undergoing direct collision, the particles may be recycled through the system 100 (i.e., the flow of the mixed heterogeneous material 106 through the pump 104 may be increased with respect to the flow of the stream 136 to the separation system 140) and/or passed through more than one ablation system 100 in series.

Figure 7:
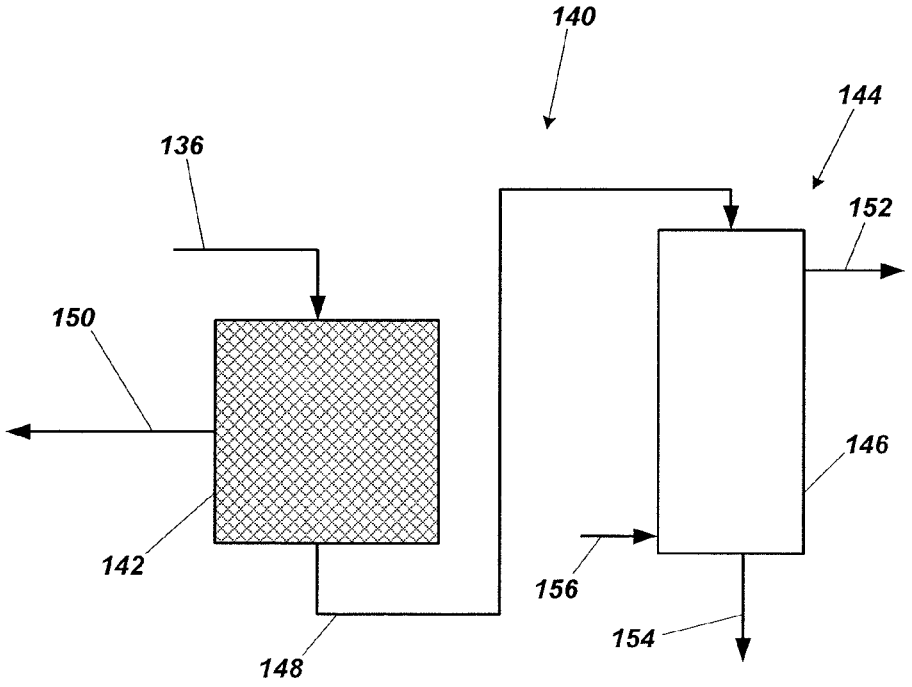
FIG. 7 is a simplified schematic illustrating a portion of the system shown in FIG. 3.
Figure 8:
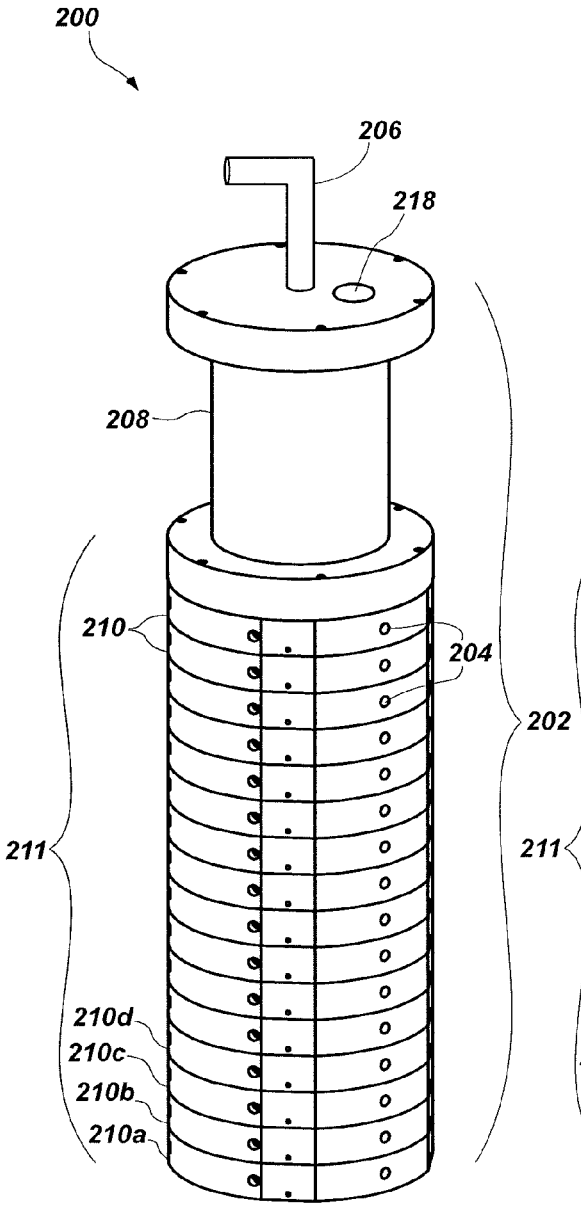
FIG. 8 is a simplified view of an embodiment of an elutriator.

In some embodiments, a separation system 140 may be designed to separate portions of the stream 136 by size, shape, density, magnetic character, electrostatic charge, or any other property of particles of the stream 136. For example, in one embodiment and as shown in FIG. 7, the separation system 140 may include a screen 142 (e.g., a rotary screen, an angled screen, etc.) to remove particles larger than a selected size. For example, the screen 142 may allow fines 148 (i.e., particles smaller than the mesh size of the screen 142 (e.g., 140 wires per in. (55 wires per cm))) to pass through the screen 142. Grains 150 (i.e., particles larger than the mesh size of the screen 142) may be diverted elsewhere. The fines 148, the grains 150, or both, may be selected for further processing. For example, in a stream 136 containing gold particles, the grains 150 may contain the gold, whereas the fines 148 may be substantially free of gold. In such embodiments, the fines 148 may be discarded or returned to the mine as barren waste (i.e., waste substantially free of a material of interest). In a stream 136 containing uranium ore, the fines 148 may contain uranium, whereas the grains 150 may contain barren ore. In such embodiments, the grains 150 may be returned to a uranium mine as barren waste, and the fines 148 may be further separated, such as in a gravimetric separator 144.

A portion of the stream 136 (e.g., the fines 148) may pass into a gravimetric separator 144 for further separation. The particles of the stream 136 in the gravimetric separator 144 may have approximately uniform particle sizes, making them inseparable by screening, but separable on the basis of density. For example, the gravimetric separator 144 may be an elutriation system including a vertical column 146. As used herein, the term "elutriation" means and includes a process of separating materials based on differences in density. The portion of the stream 136 to be separated (e.g., the fines 148) may enter the top of the vertical column 146. A fluid 156 (e.g., water) may be continually introduced into the bottom of the vertical column 146 and may flow upward through the vertical column 146. The flow of fluid 156 through the vertical column 146 may be in either a laminar or a turbulent regime. It may be desirable to pass fluid 156 through the vertical column 146 in the turbulent flow regime because surface roughness and flow perturbations may be inconsequential for turbulent flow, and control may therefore be simpler. By regulating the rate at which fluid 156 is introduced into the vertical column 146, it may be possible to control the vertical flow rate within the vertical column 146 so that light fines 152 (particles having densities below a selected value) exit the top of the vertical column 146 with the fluid 156, whereas heavy fines 154 (particles having densities above the selected value) sink to the bottom of the vertical column 146. The heavy fines 154 may be continuously extracted from the bottom of the vertical column 146, and the volume of the fines removed may be replaced with makeup water added at the bottom of the vertical column 146. Alternatively, the gravimetric separator 144 may be operated in batch mode, and the heavy fines 154 may be removed between operations.

The light fines 152 may be directed to another apparatus (e.g., a hydrocyclone, an evaporator, etc.) for separation of the fluid 156 therefrom. In some embodiments, the gravimetric separator 144 may include two or more vertical columns 146 in series, to enhance separation, or in parallel, to increase volumetric flow. Separation of the heavy fines 154 from the light fines 152 may decrease the amount of material to be processed to recover a target material of interest, and may decrease the amount of the target material of interest left in non-bearing fractions. Fluids 156 used in the operation of the system may be cleaned by reverse osmosis, filtration, ion exchange, or any other method known in the art.

Figure 9:
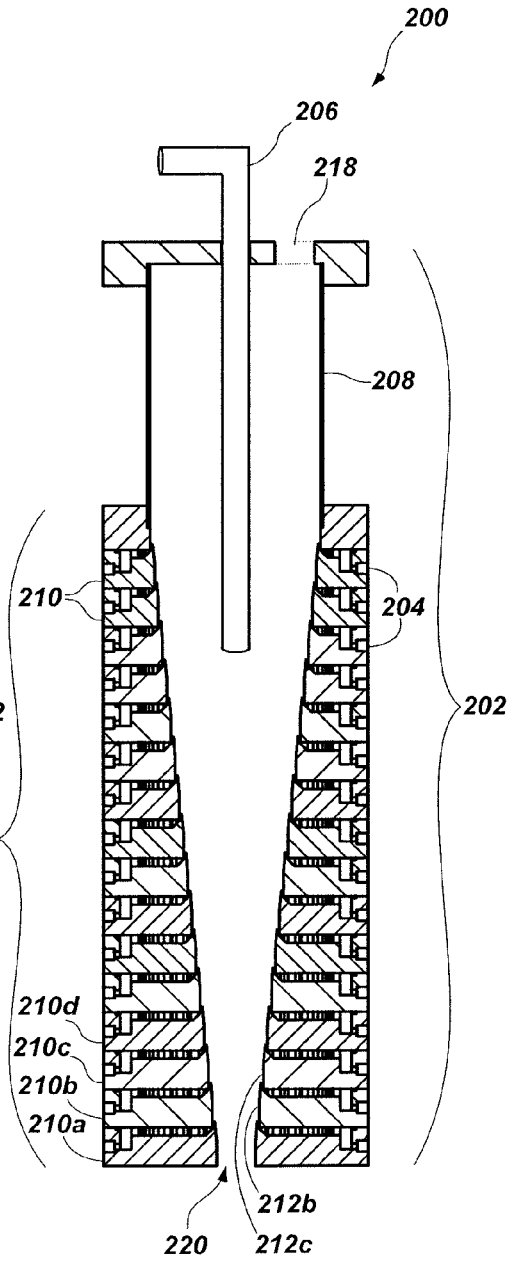
FIG. 9 is a simplified cross-sectional view of the elutriator of FIG. 8.

In some embodiments, the gravimetric separator 144 depicted in FIG. 7 may be an elutriator 200, as shown in FIGS. 8 through 11. A cross section of the elutriator 200 is shown in FIG. 9. The elutriator 200 includes a column 202 having a plurality of fluid inputs 204 and a slurry input 206. The column 202 may include a generally cylindrical upper portion 208 and a plurality of cylindrical stages 210 (e.g., 210*a*, 210*b*, 210*c*, 210*d*, etc.), forming a lower portion 211 having a generally conical interior. The elutriator 200 may be configured such that the higher-density particles settle to the bottom of the column 202, and the lower-density particles rise to the top of the column 202. For example, water may enter the column 202 via the fluid inputs 204 in the plurality of cylindrical stages 210. The water may be directed upward in the column 202 as the water leaves each cylindrical stage 210, such that water entering the column 202 from each fluid input 204 flows parallel to water entering from adjacent fluid inputs 204. The water may flow upward through the column 202 in a turbulent flow regime (e.g., with a Reynolds number of at least about 2,300, at least about 10,000, at least about 50,000, or even at least about 100,000).

The column 202 may have a geometry selected to minimize or eliminate the boundary layer between the water and walls of the column 202. For example, the cylindrical stages 210 may each include a fluid input 204 configured to deliver a portion of water. The fluid input 204 in the first stage 210*a* may provide water flowing into a void defined by an inside wall 212*b* of the second stage 210*b* at a selected velocity. The water flowing into the column 202 through the first stage 210*a* fills the entire void defined by an inside wall 212*b* of the second stage 210*b*. The fluid input 204 in the second stage 210*b* may provide water such that the water flows through a void defined by an inside wall 212*c* of the third stage 210*c* at the same selected velocity. The water flowing into the column 202 through the second stage 210*b* fills void defined by an inside wall 212*c* of the third stage 210*c*, which may be significantly smaller than the void defined by the inside wall 212*b* of the second stage 210*b*. Thus, the flow through the second stage 210*b* may be significantly smaller than the flow through the first stage 210*a*. Thus, each fluid input 204 may provide water sufficient to maintain a constant flow velocity from the bottom of the column 202 to the top of the column 202.

Figure 10:
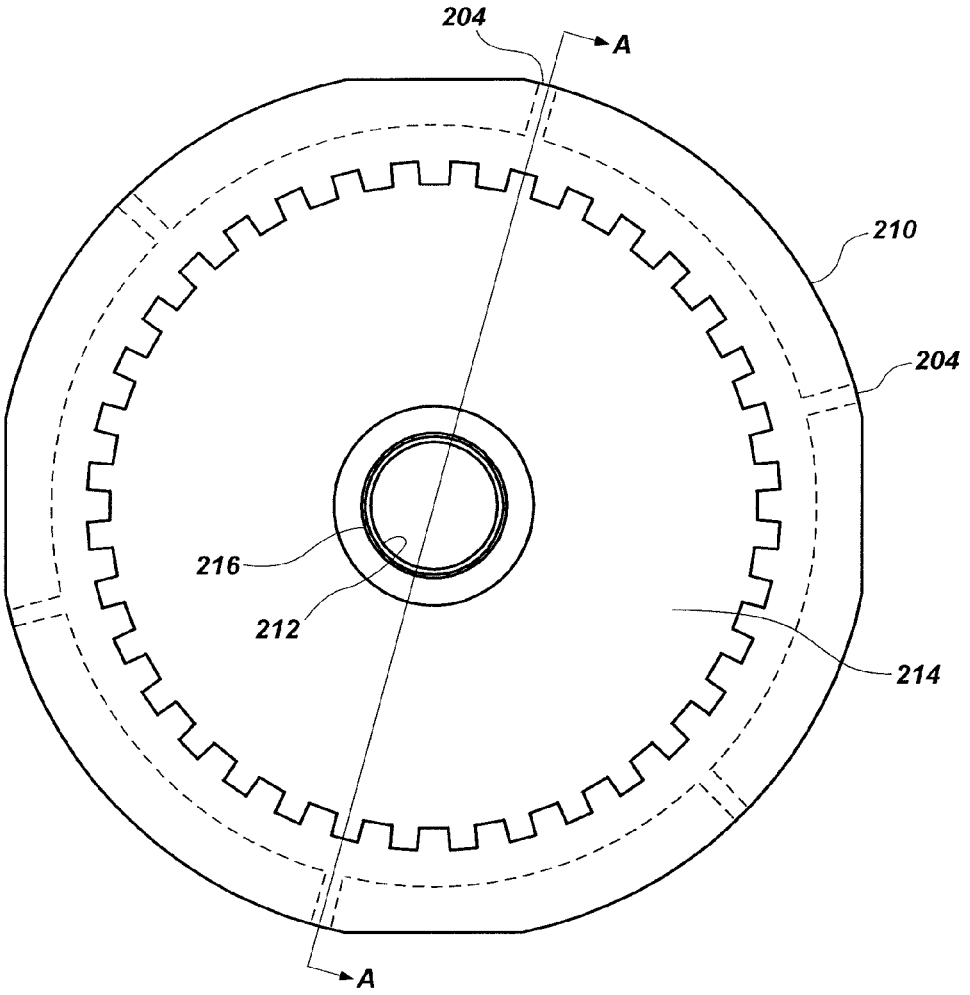
FIG. 10 is a simplified view of a cylindrical stage of the elutriator of FIG. 8.
Figure 11:
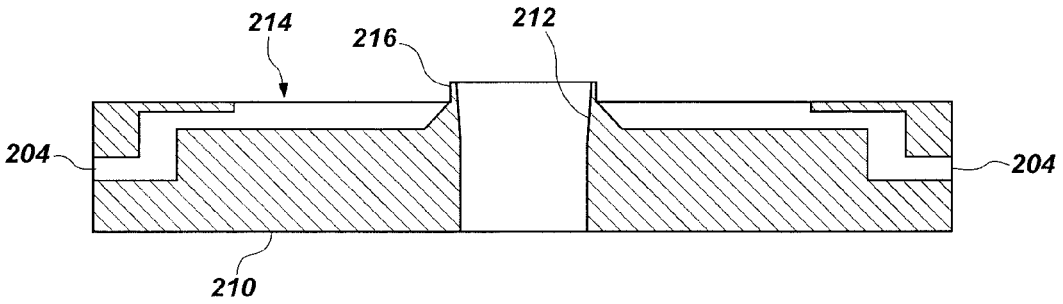
FIG. 11 is a simplified cross-sectional view of the cylindrical stage of FIG. 10.

A top view of a single cylindrical stage 210 is shown in FIG. 10, and a section view through line A-A is shown in FIG. 11. The stage 210 shown is a cylindrical body and includes six fluid inputs 204 spaced around the stage 210, but the stage 210 may be any shape and include any number of fluid inputs 204. Fluid enters the stage 210 through the fluid inputs 204, and passes through a channel 214. The channel 214 may be a cylindrical void, open along an upper side of the stage 210. When the stage 210 is stacked in the column 202 (FIGS. 8 and 9), another stage 210 may provide a boundary of the channel 214 to direct the flow toward the inside wall 212. The fluid then flows through the channel 214 toward the center of the stage 210, where a lip 216 deflects the fluid upward. The fluid then leaves the stage 210 and flows upward in the column 202.

The stages 210 may direct the fluid upward within an annular area (e.g., the area between the lip 216 of the stage 210 and the inside wall 212 of the stage 210 above), and may continuously interrupt the boundary layers at the inside wall 212. Because the fluid from each stage 210 (starting with second stage 210*b*) is directed upward around flowing fluid from lower stages 210, the volume near the lip 216 in which the fluid has a low-velocity fluid is relatively small. That is, the upward-flowing fluid in the center of the column 202 tends to carry fluid that would otherwise flow slowly (due to the no-slip boundary condition of fluid mechanics) at the lip 216. As the combined fluid flows upward, the fluid entering through the stage 210 may tend to mix with the fluid from lower stages 210. The velocity profile of the combined fluid may tend to flatten, forming a more uniform flow as the fluid rises. In embodiments in which the flow velocity increases slightly from the bottom of the column 202 to the top of the column 202, the velocity may be slightly higher near the walls of the column 202 than at the center. Such a velocity profile may tend to cause heavier particles (e.g., particles having a terminal velocity higher than the average velocity of the fluid) to fall downward and toward the center of the column 202, while lighter particles rise to the top of the column 202.

Particles of material to be separated may enter the elutriator 200 near the top of the column 202 via the slurry input 206. Though illustrated as a single flow into the center of the column 202, the slurry input 206 may include one or more nozzles, a distribution manifold, a spray, or any other means to disperse particles within the column 202. Particles of material in the slurry may be separated based on gravitational forces and forces of the water. Thus, particle mass, particle surface area, and fluid flow conditions may each affect the speed and direction of travel of a particular particle. In particular, a particle on which the gravitational force exceeds the force of the water will fall in the column 202, and a particle on which the force of the water exceeds the gravitational force will rise in the column 202.

Figure 12:
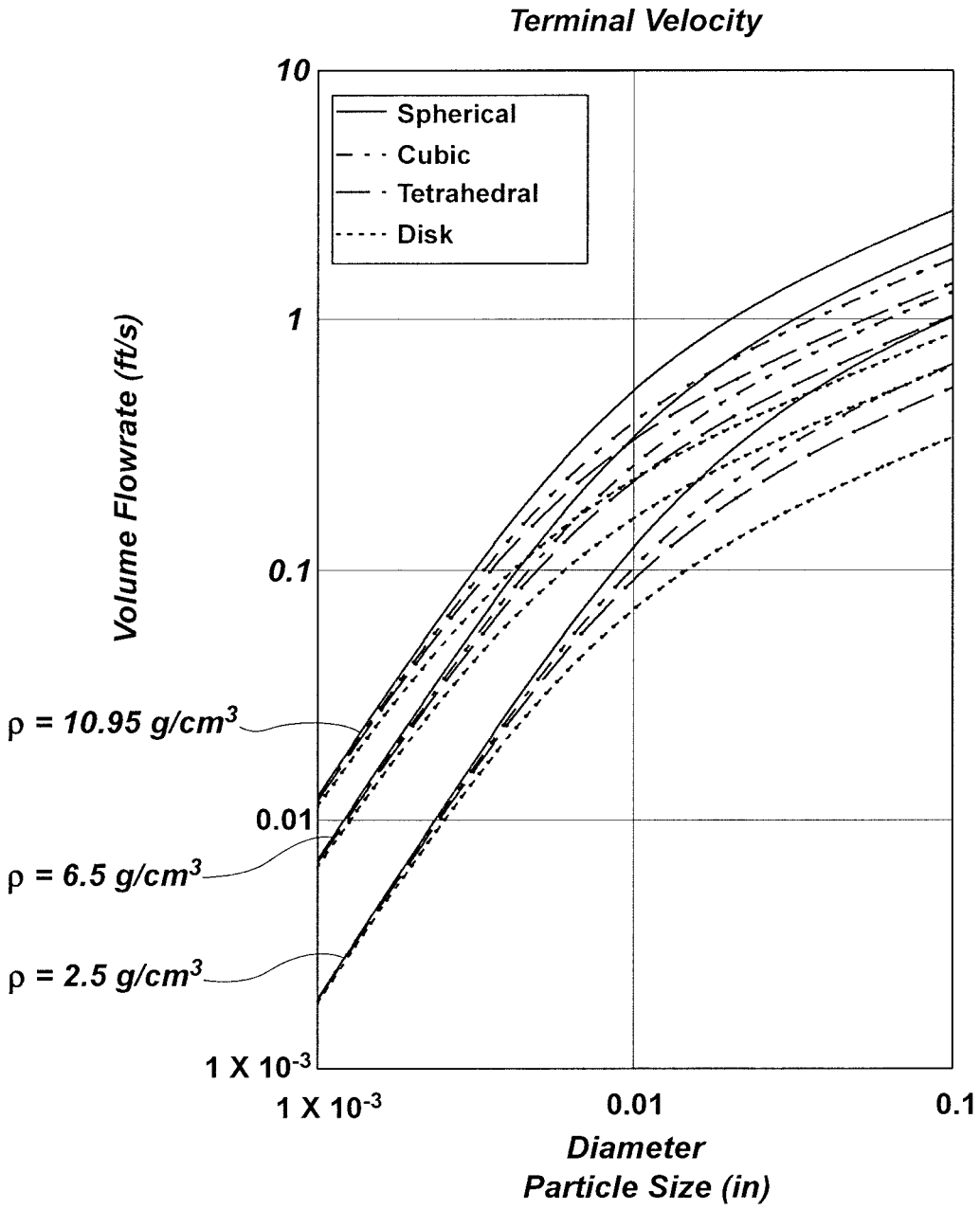
FIG. 12 is a graph illustrating the calculated terminal velocity of selected particles in an elutriator according to an embodiment of the present disclosure.

The movement of particles in the column 202 may be characterized as a flow of particles in an upward-flowing stream of water. In such a characterization, calculation of the terminal velocities of particles is instructive, and may aid in the design or selection of the elutriator 200. FIG. 12 shows calculated terminal velocities for particles of various geometry and density. FIG. 12 includes terminal velocities based on four particle shapes (sphere, cube, tetrahedron, and disk) and three densities ($\rho$=2.5 g/cm$^3$, $\rho$=6.5 g/cm$^3$, and $\rho$=10.95 g/cm$^3$). As shown in FIG. 12, the terminal velocities of smaller particles are influenced less by the particles' shapes than the terminal velocities of larger particles. Thus, terminal velocities of smaller particles of a selected density are more closely clustered than terminal velocities of larger particles of the same density. This makes classification of smaller particles by their densities relatively more effective than classification of larger particles. For example, in a sample of particles having an effective diameter of approximately 0.002 in. (0.051 mm), an upward water flow at a velocity of between about 0.009 and 0.02 ft/s (between about 0.0027 and 0.0060 m/s) would effectively separate particles (whether spherical, cubic, tetrahedral, or disk-shaped) having a density of 2.5 g/cm$^3$ from particles having a density of 6.5 g/cm$^3$. As used herein, the term "effective diameter" of a particle means the diameter of a hypothetical spherical particle having the same mass as the particle. In a sample of particles having an effective diameter of approximately 0.010 in. (0.25 mm), a water flow rate of between about 0.13 and 0.16 ft/s (between about 0.040 and 0.049 m/s) would effectively separate particles (whether spherical, cubic, tetrahedral, or disk-shaped) having a density of 2.5 g/cm$^3$ from particles having a density of 6.5 g/cm$^3$. For particles having an effective diameter larger than about 0.015 in. (0.38 mm), separation of particles having a density of 2.5 g/cm$^3$ from particles having a density of 6.5 g/cm$^3$ may not be possible if one or both materials include particles of differing geometry. That is, the terminal velocity curve for disk-shaped particles having a density of 6.5 g/cm$^3$ crosses the terminal velocity curve for spherical particles having a density of 2.5 g/cm$^3$ at a particle diameter of about 0.015 in. (0.38 mm).

Particles (e.g., lower-density particles) that flow upward in the column 202 may eventually reach an upper outlet 218 (FIGS. 8 and 9), where particles may be collected and removed from the elutriator 200 with the fluid. Particles (e.g., higher-density particles) that flow downward in the column 202 may eventually reach a lower outlet 220 (FIG. 9), where particles may be collected and removed.

The elutriator 200 may include multiple columns 202 selected and configured to separate different materials. For example, the particles collected from the upper outlet 218 or the lower outlet 220 of the column 202 may be transferred to another column 202 having different dimensions or flow rates for subsequent separation. In some embodiments, the column 202 of the elutriator 200 may include additional outlets for withdrawing materials.

The flow of materials into and out of the elutriator 200 may be measured and/or controlled by flow meters, valves, a computer control system, etc. (e.g., the computer 184 shown in FIG. 3).

Referring again to FIG. 7, in embodiments in which the mixed heterogeneous material 106 (FIG. 3) contains uranium ore, the gravimetric separator 144 may be used to separate light fines 152 from heavy fines 154. The light fines 152 may include barren material and carbonaceous materials, and the heavy fines 154 may include uranium-bearing minerals, such as uraninite. Processing of uranium ore in the system 100 (FIG. 3) including in the separation system 140 may produce a concentration of less than about 1.0 parts per million (ppm) of uranium in waste fractions (e.g., light fines 152, grains 150, and oversize materials). The system 100 may be used to process uranium left behind in ore previously processed by ISR techniques.

Though described herein as having a screen 142 followed by a gravimetric separator 144, other separation equipment and techniques may be used to separate portions of the mixed heterogeneous material 106. For example, in some embodiments, the screen 142 or the gravimetric separator 144 may be used alone. In other embodiments, the gravimetric separator 144 may precede the screen 142 in the process. Furthermore, the gravimetric separator 144 may include any other equipment for classifying materials based on specific gravity, such as a centrifuge, a shaking table, a spiral separator, etc., instead of or in addition to the vertical column 146.

Figure 13:
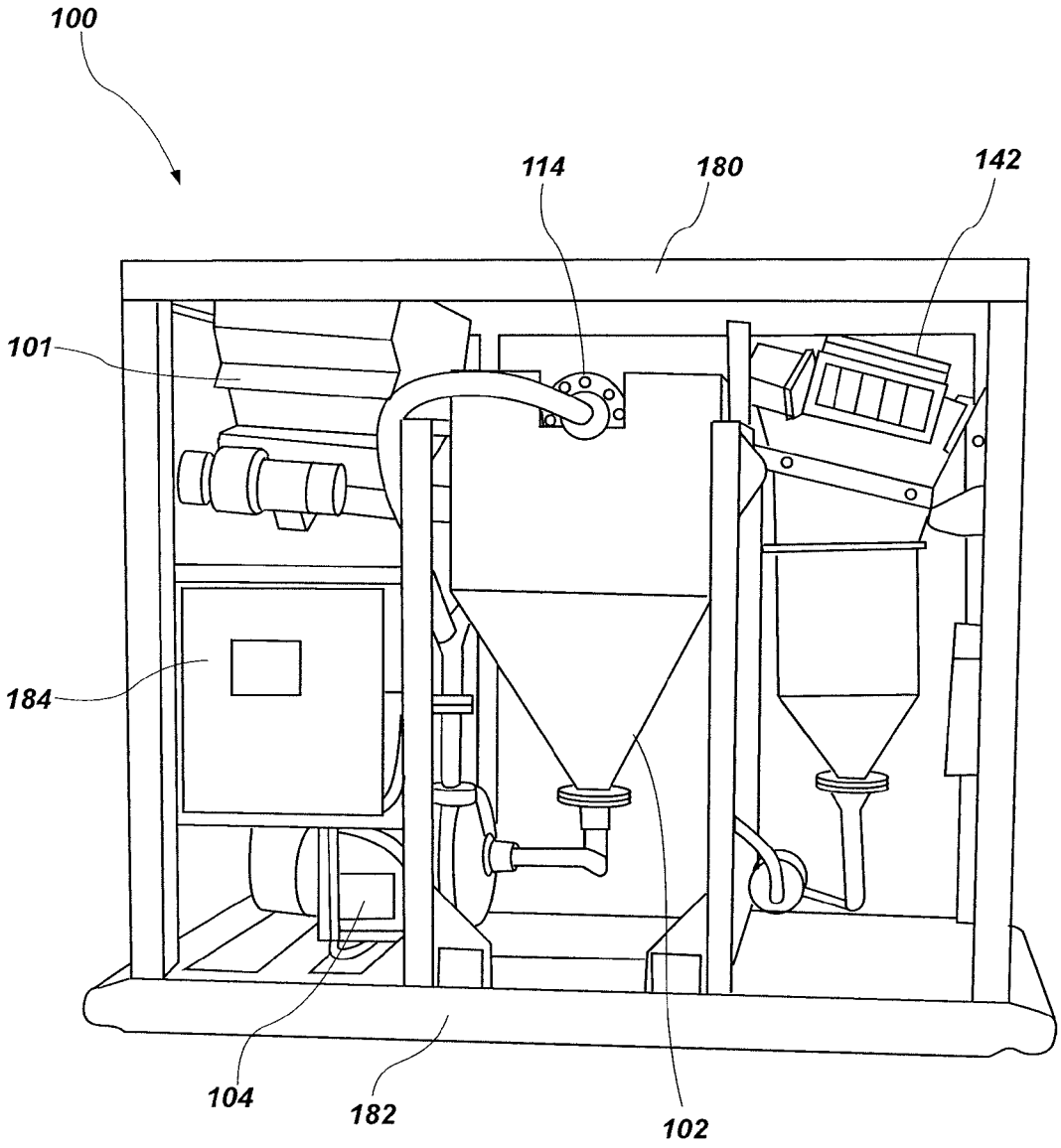
FIG. 13 is a side view of an embodiment of a system for processing a heterogeneous material.

As shown in FIG. 13, the system 100 for processing a heterogeneous material may be disposed within a single container. For example, the system 100 may be contained substantially within a frame 180 on a skid or pallet 182 configured to be carried by a forklift and/or a commercial truck, such that the system 100 may be transported and operated without disassembly. In other words, the components of the system 100 may be entirely disposed within the frame 180, with the exception of portions of piping, wiring, covers, etc. The frame 180 may surround and protect the system 100 during transport, but may be open such that the system 100 may be operated without removing the system 100 from the frame 180. Thus, onsite setup requirements and the costs associated with moving the system 100 may be minimized. The system 100 may include equipment as discussed above and shown schematically in FIGS. 3 and 7, such as a tank 102, a pump 104, a nozzle assembly 114, a gravimetric separator 144, etc. Furthermore, the system 100 may include a computer 184 configured to monitor and/or control operation of the system 100. In some embodiments, the frame 180 may have a length of from about 2 feet (0.61 m) to about 10 feet (3.0 m), a width of from about 2 feet (0.61 m) to about 8 feet (2.4 m), and a height of about 2 feet (0.61 m) to about 8 feet (2.4 m). The system 100 may have a weight of, for example, from about 100 lbs (45.4 kg) to about 4,000 lbs (1814 kg). In some embodiments, the system 100 may be installed in a temporary or permanent facility. In other embodiments, the system 100 may include unitized components configured to be transported by multiple commercial vehicles. For example, the system 100 may be transported on five 30-foot trailers.

The system 100 may also include one or more analytical instruments (not shown). For example, the system 100 may include instruments configured to test X-ray fluorescence, gamma radiation (e.g., to determine the concentrations of various isotopes of a material), turbidity, pH, bicarbonate ion concentration, particle size distribution (e.g., by laser particle analysis) etc. The analytical instruments may be controlled by the computer 184. The computer 184 may use data from the analytical instruments to calculate a mass balance in real time. The computed mass balance may be used in the control mechanism of the system 100, quality control, maintenance, accounting, etc. For example, the computer 184 may track the amount of material processed in the system 100 or the amount of a selected material produced. Thus, an operator of the system 100 may make informed decisions regarding maintenance intervals, payment of usage fees, etc.

In some embodiments, the system 100 may be configured to optionally be used in conjunction with other systems 100. For example, a material (e.g., ore from a mining operation) may be processed in a first ablation system. After ablation in the first ablation system, ablated material may optionally be processed in a second ablation system. In some embodiments, the ablated material leaving the first ablation system may be tested to determine whether subsequent processing is necessary or desirable. The material may be processed through as many ablation systems as necessary to achieve desired material properties. The flow of material through ablation systems may be varied during operations. For example, during a mining operation, material properties may vary widely within a formation. Some materials may be profitably processed through a single ablation system, whereas other materials may be profitably processed through two or more ablation systems in series. The flow of materials through various ablation systems may be varied during mining operations in response to changes in materials to be processed.

Figure 14:
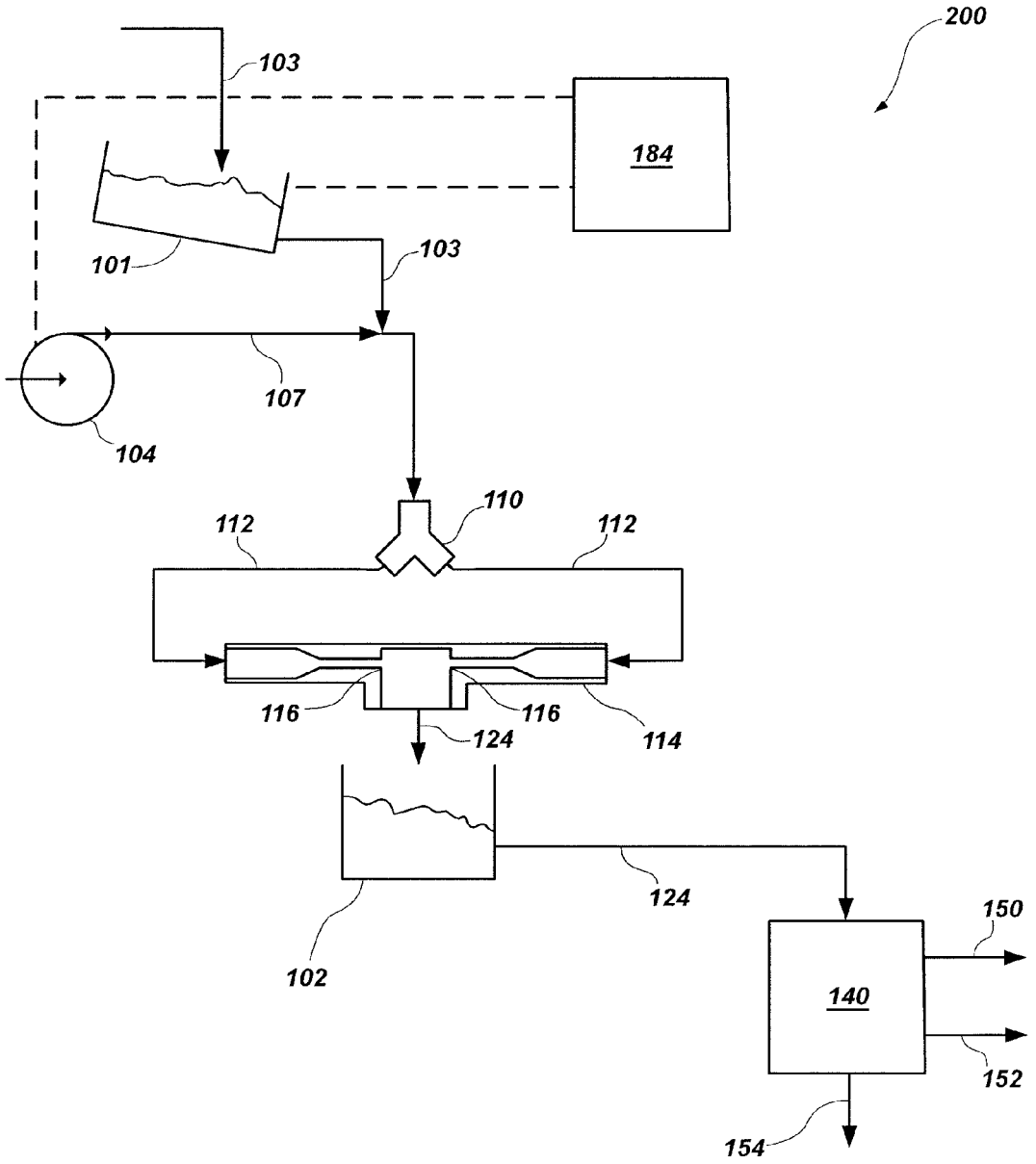
FIG. 14 is a simplified schematic illustrating another embodiment of a system for processing a heterogeneous material.

In some embodiments, and as shown in FIG. 14, system 200 (e.g., a pneumatic ablation system) may include a pressurized fluid source 107. The pressurized fluid source 107 may be compressed air from a pump 104 or a compressor, or may be water, oil, or any other fluid. The pressurized fluid source 107 may pass through a conduit to a nozzle assembly (e.g., any of nozzle assemblies 114, 114', 114", as described previously herein and shown in FIGS. 4 through 6), optionally passing through a splitter 110. The fluid of the pressurized fluid source 107 may entrain a heterogeneous material 103, such as from a hopper 101. An ablated heterogeneous material 124 may pass optionally into a tank 102 (e.g., a collection bin, a hopper, etc.) and then to a separation system 140. A transport apparatus (e.g., a conveyor belt, a chute, etc.) may carry the ablated heterogeneous material 124 to the separation system 140. The system 200 may include a computer 184 for control, data collection, etc.

Heterogeneous materials may be processed with the system 100, 200 described herein. In some embodiments, heterogeneous material is crushed and/or screened to remove particles larger than a selected size, such as particles that are too large to be effectively processed in the system 100, 200. For example, in some embodiments, particles larger than about 0.25 in. (larger than about 6.35 mm) may be removed. In many sandstone-hosted uranium ores, from about 5% to about 30% or more of the material forms particles larger than about 0.25 in. (larger than about 6.35 mm) upon crushing. In such materials, particles of ore larger than about 0.25 in. that have been mechanically crushed may contain no uranium compounds. Therefore, these particles need not be processed by the ablating process described herein if the goal is uranium recovery. These particles may instead be discarded as barren waste, used to reclaim mines, etc.

In other embodiments, no screening is necessary. For example, some heterogeneous solid feedstocks may already be entirely within size requirements of the system. For example, in the processing of oil-contaminated sand or silicate-coated gold, grains of material may all be within a range of sizes that may pass through the system.

Methods may include mixing the heterogeneous material with a liquid to form a slurry. For example, the slurry may be formed in a tank 102, as shown in FIG. 3. In some embodiments, the heterogeneous material may be mixed with the liquid before adding the heterogeneous material to the system. For example, in embodiments in which the heterogeneous material is ore from an underground formation, the ore may be extracted by borehole mining. In borehole mining, the ore is extracted from the formation by high-pressure water jets, and is carried to the earth's surface by the water. The mixing of the heterogeneous solid ore with the liquid water therefore occurs in the underground formation. The slurry may have any ratio of solids-to-liquids as long as the flow can transport the solids to an impact zone. In some embodiments, the slurry may include from about 5% to about 50% solids by mass, such as between about 10% and about 20% solids by mass.

Methods may further include pumping streams of the slurry through a nozzle assembly (e.g., any of nozzle assemblies 114, 114', 114", as described previously herein and shown in FIGS. 4 through 6) and impacting the streams (and therefore the particles therein) to ablate particles of the slurry against one another. The streams may, in the process, recombine into a single slurry stream. The heterogeneous material may separate into discrete fractions in the ablation process. For example, coatings may be removed from particles of the heterogeneous material in the ablation process. In some embodiments, all or a portion of the slurry may be recycled through the system (e.g., returned to the tank 102).

The slurry that has been processed through the nozzle assembly may be processed to separate particles by size. For example, the slurry may be passed through a screen to separate particles larger than a mesh size of the screen from particles smaller than the mesh size of the screen. For example, the particles of the slurry may be separated into grains larger than 0.004 in. (0.10 mm) and fines smaller than 0.004 in. (0.10 mm) by appropriately selecting the mesh size of the screen. In some embodiments, multiple separations may be performed, such as by passing portions of the slurry through multiple screens in series. Different size classifications may be selected by selecting one or more appropriate screens.

Particles having approximately the same size (such that separation by size classification may be difficult or expensive) may have different compositions, and separation of particles with different compositions may be desirable. For example, uranium-rich fines may have similar sizes as non-bearing or uranium-depleted fines formed from ablation of material from a single formation. Light and heavy fines may require different techniques to recover uranium. Therefore, to reduce the amount of material that must be processed by other means (e.g., chemically) to extract the uranium, the fines may be separated gravimetrically. For example, the fines may be disposed in a vertical column of water, and a fluid may flow upward through the column, such as at turbulent flow rates. The fluid may be water, mineral oil, an organic solvent, air, etc. Water may be selected based on its flow properties, availability, and minimal environmental impact, but other fluids may be used instead. The fines may be separated in the column by their densities, with heavier fines dropping to the bottom, and lighter fines rising to the top. Gravimetric separation may be performed in one or more stages, with different stages having different densities at which the separation occurs. Various parameters may affect the separation, such as the type of fluid used, the temperature, the flow rates, the size of the column, etc.

Fluids used in the process, such as in the slurry or in the gravimetric separation, may be removed from the solids in a dewatering operation. Fluids may be processed by filtration, ion exchange, reverse osmosis, etc., to remove residual impurities, enabling recycling of the fluids.

The ablation process described herein may be coupled with borehole mining, the borehole mine providing the heterogeneous material 103 to be processed. In some embodiments, the heterogeneous material 103 is an ore, such as a uranium-bearing ore. The use of borehole mining in conjunction with an ablation system as described herein may provide operational, environmental, and other advantages. For example, borehole mining may be used to extract minerals from unbounded deposits, deposits located above the water table, shallow deposits with insufficient hydrologic permeability, deposits in impermeable rock formations, or small deposits of minerals that may not be economically, technically, or lawfully recoverable by conventional ISR. Borehole mining may be performed in independent wells that do not have to be connected to other wells in the field. A single well may be used to penetrate a formation, scour the ore from the formation, carry the scoured ore to the surface by a slurry, and return barren fractions of processed ore to the formation. This may allow extraction of minerals with a reduced surface footprint in comparison to conventional methods.

Borehole mining is a technique for extracting mineral deposits from an underground formation. Typically, a borehole is drilled to a desired depth. A casing may be inserted into a portion of the borehole. A borehole mining tool is inserted into the borehole, and water is pumped into the tool to produce high-pressure water jets. The jets scour ore from the formation, and the mined ore is carried to the surface in a slurry of the water. Though borehole mining has been demonstrated as a method of mining underground deposits, the method generally requires a nearby mill, and may require further separation of ore after transport to the surface.

Borehole mining, a water-only approach, may enable the removal of minerals that may conventionally (e.g., via ISR) be removed by injecting a leachate or lixiviant into a formation, but without problems associated with the use of leachates or lixiviants. In borehole mining, water jets may physically remove formation material without chemically mobilizing or dissolving metals, limiting the risk of aquifer contamination. Water jets may operate without modifying formation chemistry and without additional reagent costs. Borehole mining may also be simpler than conventional ISR. Because material of the formation is extracted, rather than processed in-situ, borehole mining may begin with less information known about the formation. Though the boundaries of the formation and geological characteristic may still need to be probed, geochemical classification and permeability of the formation are not necessary to perform a borehole mining operation because borehole mining does not rely on chemical reaction or on permeation.

In some embodiments, borehole mining may be used to scour ore from a wedge-shaped volume of an underground formation. The extent of the volume may be tailored by controlling the direction, location, and intensity of the water jets. Borehole mining may therefore be used to asymmetrically excavate the formation, roughly following formation boundaries. The ore from the wedge-shaped volume may be extracted and processed. The wedge may then be refilled, such as with barren waste or fill and, optionally, a cementing material. Additional volumes of material may be extracted in a similar manner. Additional volumes may be excavated from a well in which volumes have previously been excavated and refilled. The refilled volumes may provide structural support for later-excavated volumes. Reinjection of the barren waste may reduce surface disturbance and reclamation requirements. When used in conjunction with borehole mining, the systems described herein may include a surge tank to regulate the flow of material to the systems.

The ablation process described herein may also be used to process feedstocks from other types of mining operations, such as open-pit mining or underground mining. In such operations, ore may be mined conventionally and processed by ablation, for example, near the mine. The barren waste may be returned to the mine, leaving a small bearing fraction. The bearing fraction may be transported elsewhere for further processing. By separating the ore by ablation near the mine, transportation costs may be greatly reduced.

In some embodiments, the ablation process described herein may be used to process material having a concentration of mineral components too low for economic recovery by conventional processes. For example, waste or overburden from other mining operations may be processed using ablation. Furthermore, materials may be treated by ablation to aid in environmental remediation, such as by lowering the concentration of chemical species in material previously mined. For example, the ablation process may be used for remediation of contaminated land near mines no longer operating. In such embodiments, the goal may be clean-up of a site. The chemical species recovered may be disposed of (the mass containing the chemical species being much smaller than the total mass initially contaminated), sold, or further processed.

The system and method disclosed herein may be scaled as dictated by constraints of a particular application (e.g., cost, portability, operating footprint, etc.). For example, the system 100, 200 may have a capacity of from about 750 to about 1,000 lbs per hour (about 340 to about 454 kilograms per hour), and may fit within the frame 180, as shown in FIG. 13. Other systems 100, 200 may have a capacity of about 40,000 lbs per hour (about 20 tons per hour or 18,100 kilograms per hour) or more. The capacity of the system 100, 200 may be varied by varying the capacity of individual components, as known in the art. The capacity of the nozzle assembly 114 may be varied by varying the size and/or number of nozzles 116 or the particle size distribution of the mixed heterogeneous material 106 entering the system 100, 200.

The systems and methods disclosed herein may be used to quickly separate portions of materials using water, without the addition of chemical reactants. Water may provide energy to physically dissociate the portions into discrete particles that may be separated based on particle size and density. In materials having coatings or patinas, the methods may significantly reduce the amount of material to be further processed to recover various components.

For example, in the processing of typical sandstone-hosted uranium ores, 95% or more of the uranium-containing compounds may be concentrated into 10% of the mass, with the remaining 90% of the mass containing only about 5% or less of the uranium-containing compounds. For example, the majority of the uranium may be in particles that pass through a 325-mesh or 400-mesh screen (i.e., particles smaller than about 0.0017 in. (0.044 mm) or 0.0015 in. (0.037 mm) diameter). In ores having relatively lower initial concentrations of uranium, the separation may be relatively less effective.

Slurry pumps (e.g., slurry pump 104) conventionally have an upper limit on the size of particles that can be processed in a slurry. Removal of particles larger than a selected size (e.g., larger than about 0.25 in. (6.35 mm)) may enable the use of a smaller pump 104 than would otherwise be utilized if these larger particles were present. However, in the processing of uranium ores, removal of such larger particles does not significantly affect uranium recovery because this ore fraction contains virtually no uranium.

The following examples serve to explain embodiments of the present disclosure in more detail. These examples are not to be construed as being exhaustive or exclusive as to the scope of this present disclosure.

EXAMPLES

Example 1: Silicate-Plated Gold Processing

Precious metal ores were extracted from hydrothermal deposits by conventional mining techniques. The ores contained micro-fine gold particles having silicate patinas. The silicate patinas interfered with gravity separation of the gold-bearing particles from barren material. The silicate chemistry made the patinas difficult to remove chemically. The ore was crushed, mixed with water to form a slurry, and passed through a pair of opposing nozzles, each having an exit diameter of 0.5 in. (12.7 mm), directed to an impact zone 118, as in the nozzle assembly 114 shown in FIG. 4, at a flow rate of 100 gpm (6.3 l/s) and a pressure of 32 psi (221 kPa). The collision of the opposing slurry streams imparted enough energy to the gold particles to remove the silica patinas after each particle had passed through the nozzle assembly 114 an average of 40 times. The process was performed in batch mode, such that an entire batch of ore was continuously recycled through the nozzle assembly 114 until the patinas were removed from the gold particles. With the patinas removed, the gold was recovered by conventional gravity separation.

Example 2: Oil-Contaminated Sand Processing

A sample of oil-contaminated sand was prepared by mixing a volume of sand with crude oil. The oil-contaminated sand was mixed with water and a bio-degradable wood product (available from LBI Renewable, of Buffalo, Wyo., under the trade name DUALZORB®) to form a slurry, and the slurry was passed through a pair of nozzles, each having an exit diameter of 0.5 in. (12.7 mm), directed to an impact zone 118, as in the nozzle assembly 114 shown in FIG. 4, at a flow rate of 40 gpm (2.52 l/s) and a pressure of 32 psi (221 kPa). The collision of the opposing slurry streams imparted enough energy to the sand to remove the crude oil coating from the sand after each particle of sand had passed through the nozzle assembly 114 an average of two times. Upon removal of the oil coating from the sand, the wood product absorbed the oil. The process was performed in batch mode, such that an entire batch of sand was recycled through the nozzle assembly 114 until the oil was removed from the sand. The cleaned sand was separated from the oil-soaked wood product and water.

The process may alternatively be performed with a surfactant (e.g., a liquid surfactant) instead of or in addition to the bio-degradable wood product. The surfactant may promote the mixture of oil with the water. The surfactant or the wood product may prevent the oil from re-coating the sand after the sand leaves the impact zone 118.

Example 3: Uranium Ore Processing

Uranium ores were mechanically extracted from a sandstone formation. The ores contained oversize materials that contained only minimal amounts of uranium. A patina of deposited fine uranium minerals coated non-uranium-bearing grains. The ores also contained fine deposits of non-uranium-bearing minerals. The ore was crushed and screened to remove the oversize materials larger than about 0.25 in. (6.35 mm). The grains and fines were processed in the system 100 shown in FIG. 3. The grains and fines were mixed with water to form a slurry having about 20% solids by weight. The slurry was pumped through a pipe having vanes to increase uniformity of the slurry, split into two streams, and passed through a pair of nozzles, each having an exit diameter of 0.5 in. (12.7 mm) directed toward an impact zone at a flow rate of 30 gpm (1.89 l/s) and a pressure of 32 psi (221 kPa). The nozzle diameter may be any appropriate size, such as 0.375 in. (9.53 mm). The collision of the opposing slurry streams imparted enough energy to the ore particles to physically remove the fines from the grains after each particle had passed through the nozzle assembly 114 an average of 15 times. With the fines removed, grains were separated from fines by screening. The fines were classified by density in a vertical column, producing a uranium-rich heavy (i.e., dense) fraction and a barren light fraction. The heavy fines were a small portion of the run-of-mine ore and were determined to be suitable for further refining (e.g., by conventional chemical means). The light fines, grains, and oversize materials were analyzed and it was determined that the concentration of uranium was low enough that the materials were suitable for use as backfill. Water used in the ablation process was found to contain dissolved uranium and radium. These elements were recovered from the water via ion exchange and reverse osmosis.

Comparative Example 4: Particle-Size Distribution of Crushed Ore and Uranium Distribution as a Function of Particle Size A sample of uranium-bearing sandstone was mechanically crushed just enough to break joints between grains, leaving the underlying grain structure intact. The crushed ore was segregated by screening to remove particles larger than 0.25 in. (6.35 mm). The sample included a mixture of ores from multiple sandstone-hosted uranium deposits located in the western United States. However, despite being from different deposits, each ore exhibited common characteristics, including an identifiable grain structure of quartz and feldspars, similar pre-ablation size distributions, and the presence of carbonaceous materials up to 25.4 mm (1 in.) in size.

Figure 15:
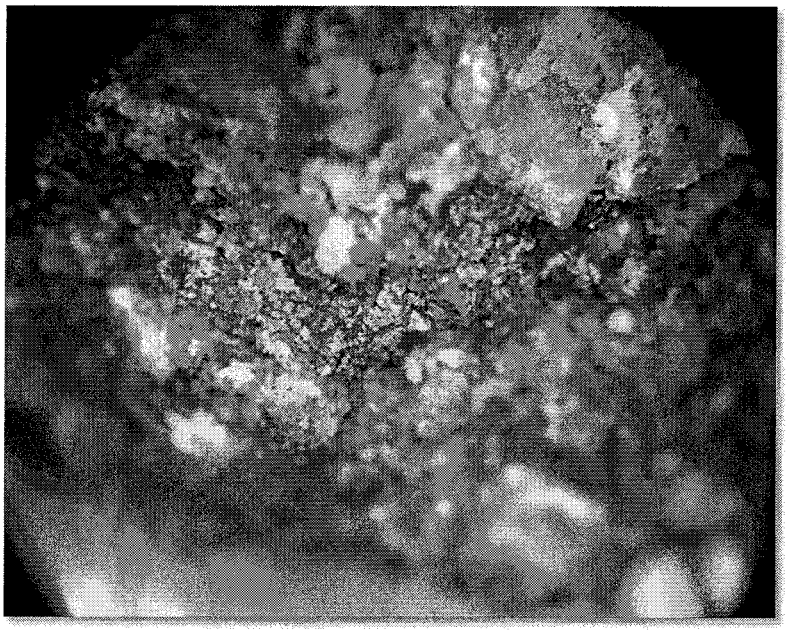
FIGS. 15 through 17 are photomicrographs of ore samples from sandstone-hosted uranium deposits.
Figure 16:
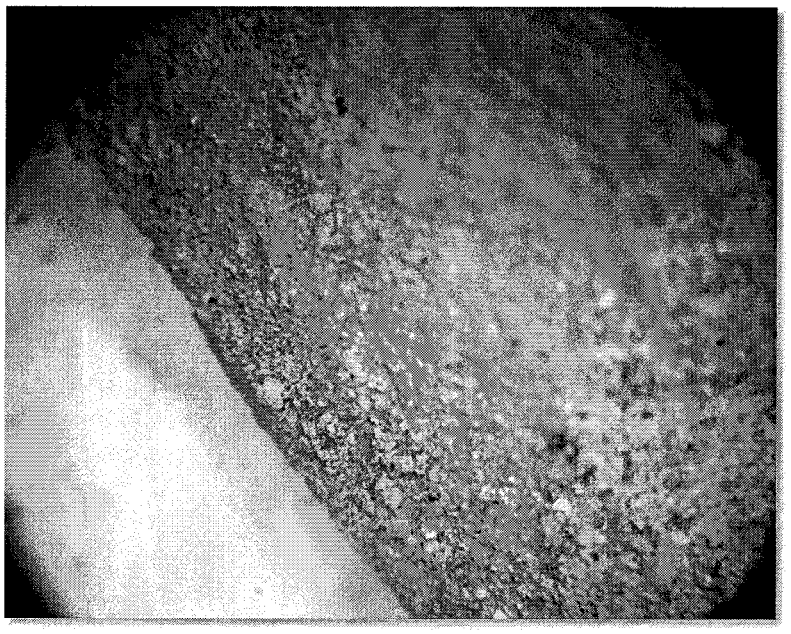
Figure 17:
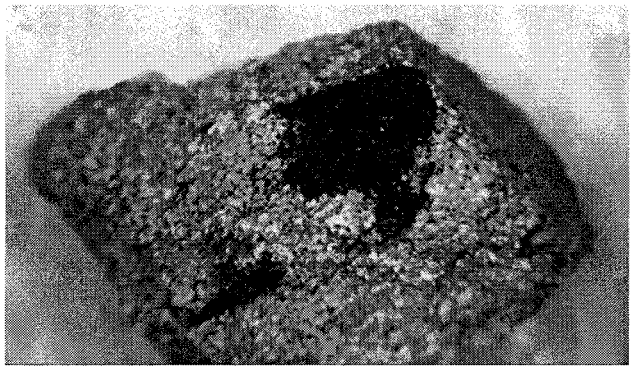

Like ores from many sandstone-hosted deposits, the ores tested had clearly identifiable grains ranging in size from less than 1 mm to more than 10 mm. As shown in FIG. 15, one portion of an ore sample is characterized by relatively large grains. As shown in FIG. 16, taken at the same magnification, another portion of the same ore has a relatively finer grain structure. A range of grain sizes within ore from a single deposit is typical of ore from sandstone-hosted deposits. The presence of carbonaceous materials with high post-depositional element concentrations, including uranium, is also typical of sandstone-hosted uranium ores. Carbonaceous material fragments are visible in FIG. 16 as black material. From the same ore, FIG. 17 shows carbonaceous material embedded in the patina surrounding a grain.

Figure 18:
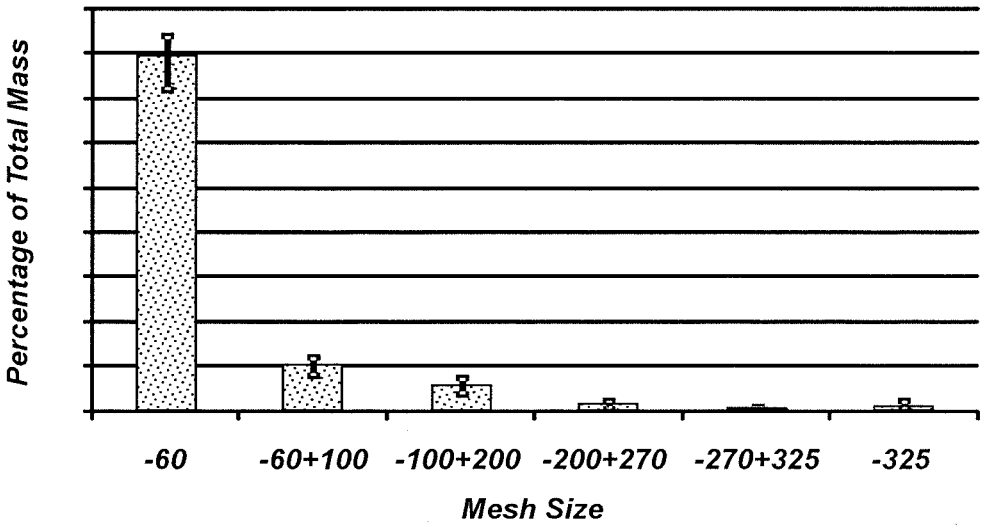
FIG. 18 is a graph illustrating a particle size distribution for a crushed sample of ore from sandstone-hosted uranium deposits.

Of the crushed ore that passed through a 0.25-in. (6.35-mm) screen, about 75% of the mass is in particles larger than 60-mesh (about 0.0098 in. (0.25 mm)), with decreasing percentages present in successively smaller size fractions. The average particle-size distribution of the particles smaller than about 0.25 in. (6.35 mm) is shown in FIG. 18 for the ores tested, including range bars showing the variation between the samples analyzed.

Figure 19:
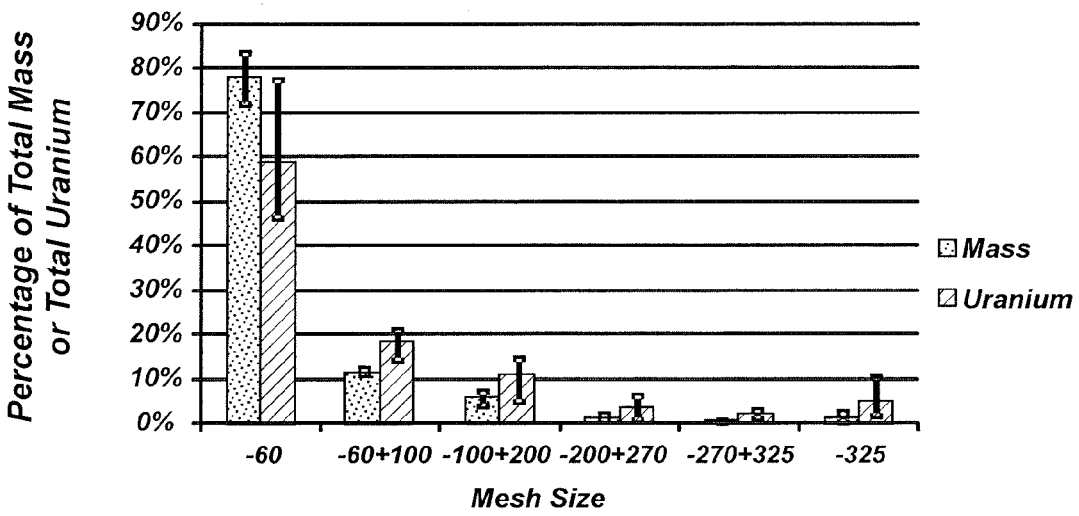
FIG. 19 is a graph illustrating a particle size distribution and a percentage of uranium in each size fraction for a crushed sample of ore from sandstone-hosted uranium deposits.

The separated particles were tested for uranium content by X-ray fluorescence (XRF). FIG. 19 shows the percentage of uranium in each size fraction smaller than 0.25 in. (6.35 mm). In general, the uranium mass distribution corresponds to the total mass distribution. FIG. 19 suggests that, in some sandstone-hosted uranium deposits, removal of a minus 0.25-in. size fraction by screening also removes a corresponding percentage of the uranium in the deposit. Further, removal of any fraction other than the plus 60-mesh size fraction would result in only a marginal reduction in the amount of ore remaining to be further processed.

Example 5: Particle-Size Distribution of Ablated Crushed Ore and Uranium Distribution as a Function of Particle Size A sample of uranium-bearing sandstone was mechanically crushed for processing by ablation. The crushed sandstone was mixed with water to form a slurry, and passed through a pair of opposing nozzles, each having an exit diameter of 0.5 in. (12.7 mm), directed to an impact zone, as in the nozzle assembly 114 shown in FIG. 4, at a flow rate of 30 gpm (1.89 l/s) and a pressure of 32 psi (221 kPa). The collision of the opposing slurry streams imparted enough energy to the sandstone particles to remove the patinas and carbonaceous materials after each particle had passed through the nozzle assembly 114 an average of 40 times. The process was performed in batch mode, such that an entire batch of ore was continuously recycled through the nozzle assembly 114 until the patinas were removed from the grains. The fines were separated into light fines and heavy fines by elutriation, such as by an elutriator 200 (see FIGS. 8 and 9).

A sample of the light fines was tested for elemental concentrations by XRF. A sample of the sandstone from which the particles were extracted (i.e., a sample that was not processed by ablation) was also tested by XRF. Table 1 lists the concentration of various elements in parts-per-million (ppm) in the light fines and in the sandstone. Carbon is not present in this analysis because the XRF analysis does not measure carbon.

TABLE 1

Concentration of elements in samples tested in Example 5

| Element | Concentration in light fines (ppm) | Concentration in Sandstone (ppm) |
|---|---|---|
| As | 25 | 6.1 |
| Ba | 1,468 | 341 |
| Bi | 307 | ND |

TABLE 1-continued

Concentration of elements in samples tested in Example 5

| Element | Concentration in light fines (ppm) | Concentration in Sandstone (ppm) |
|---|---|---|
| Ca | >100,000 | 2,886 |
| Cl | 1,891 | ND |
| Cr | 30 | 14 |
| Cu | 67 | ND |
| Fe | 11,800 | 5,974 |
| Hg | 12 | ND |
| K | 28,200 | 28,500 |
| Mn | 664 | 39 |
| S | 21,300 | 9,270 |
| Sb | 1,181 | ND |
| Sr | 779 | 63.8 |
| Ti | 1402 | 840 |
| U | 59,300 | 683 |
| V | 411 | 40 |
| Zn | 53 | 10.3 |
| Zr | 105 | 101 |

ND = not detected

Example 6: Concentration of Uranium in Heavy Fines as a Function of Particle Size A sample of heavy fines was tested from the uranium-bearing sandstone processed by ablation in Example 5. The sample of heavy fines was screened through successively finer screens to 600-mesh. After screening, the uranium concentration in each fraction was measured. The uranium concentration increased as the particle diameter decreased, never reaching an inflection point. This suggests that ablation of the sandstone forms uranium-containing fines small enough to pass through a 600-mesh screen.

Example 7: Concentration of Uranium in Slurry

Slurry was tested from the sample of uranium-bearing sandstone processed by ablation in Example 5. The slurry (including heavy fines and light fines) was centrifuged at 3,000 rpm for 50 minutes. The supernatant (liquid) was tested by inductively coupled plasma optical emission spectroscopy (ICP-OES) with a spectrometer available from Spectro Analytical Instruments GmbH, or Kleve, Germany, under the trade name CIROS® VISION, and determined to have a uranium concentration of 16 ppm. This supernatant was then filtered through a 0.45-μm filter. The filtered supernatant was tested by ICP-OES, and the uranium concentration was below the lower detection limit (approximately 1 ppm) of the ICP-OES spectrometer. The removal of uranium by a 0.45-μm filter suggests that the uranium present in the solution after centrifuging was primarily colloidal or near-colloidal in size, rather than dissolved.

In Examples 5 through 7, ablation appears to dissociate carbonaceous materials from the patinas and cementing minerals, before breaking the carbonaceous materials down into smaller fragments as light fines. However, because some carbonaceous materials are bonded together independent of coatings of grains of larger materials, some carbonaceous materials tend to remain as particles larger than minus 400-mesh particles (i.e., particles that pass through a 400-mesh screen). The mineralized patina, which appears to have relatively weaker bonds between particles of the patina, forms relatively smaller particles. After ablation, fragments of the carbonaceous material remain within each size fraction separated by the screens.

The characteristics of each uranium-bearing fraction of the ore—the pulverized mineral patina and the carbonaceous material make both easily separable from the uranium-barren materials after ablation. Because the ablated uranium mineral patina is very fine, it can be separated from the barren fractions by simply screening and capturing all the materials smaller than a selected size. In contrast, fragments of the carbonaceous materials are present in each size fraction after ablation. However, because the carbonaceous materials have relatively low specific gravities, they can be separated from barren materials in each post-ablation size fraction by elutriation. Because the carbonaceous materials have specific gravities only slightly higher than that of water, elutriation can efficiently separate these particles from the barren grains and cementing minerals. Thus, after removal of the fine particles by screening and removal of the light particles by elutriation, the remaining material may include virtually no uranium, enabling an almost complete recovery of the uranium from the ore by further processing (e.g., by chemical means) of only the fines and the light particles.

Example 8: Uranium Content of Size Fractions Before and after Ablation

A sample of uranium-bearing sandstone was mechanically crushed, as described in Example 4. The ore was screened to remove materials larger than 0.25-in. (6.35 mm). After screening, the ore was weighed to determine the volume of culinary water necessary to perform ablation. For sandstone-hosted uranium ores, the ablation system operates at peak efficiency with slurry densities of between about 10% and about 20% (i.e., when the slurry contains from about 10% to 20% solids by mass). With the appropriate volume of water added to the ablation system, the slurry pump circulated water through a mixing device, a splitter, nozzles, and a tank. The ore sample was then added to a hopper feeding the tank, and the resulting slurry was circulated through the ablation system at a flow rate of 30 gpm (1.89 l/s) and a pressure of 32 psi (221 kPa). The ablation system included a pair of opposing nozzles, each having an exit diameter of 0.5 in. (12.7 mm).

Samples of the slurry were collected after 1, 2, 5, 10, 20, and 50 minutes. At each time interval, a small amount of the slurry was discharged into a clean 5-gallon bucket. Each sample was screened through a 60-mesh stainless steel GILSON® screen and the captured material (the plus 60-mesh fraction) was tested by XRF to determine its uranium concentration. The uranium concentration in the plus 60-mesh sample was compared to the uranium concentration in a pre-ablation plus 60-mesh sample to determine at what point ablation had effectively removed the mineralized patina from the grains. Ideally, an ablation time may be determined during which the mineralized patina is removed, but the grains themselves do not break down, maximizing the volume of barren grains that can be separated from the pulverized uranium bearing patina by screening.

For these samples, a comparison of the uranium concentrations in the pre- and post-ablation plus 60 fractions suggested that, after 5 minutes, ablation had effectively removed the mineralized patina. Various factors may affect ablation time, including the thickness of the patina, the mass distribution of the pre-ablated material, and the shape of the underlying grain.

Figure 20:
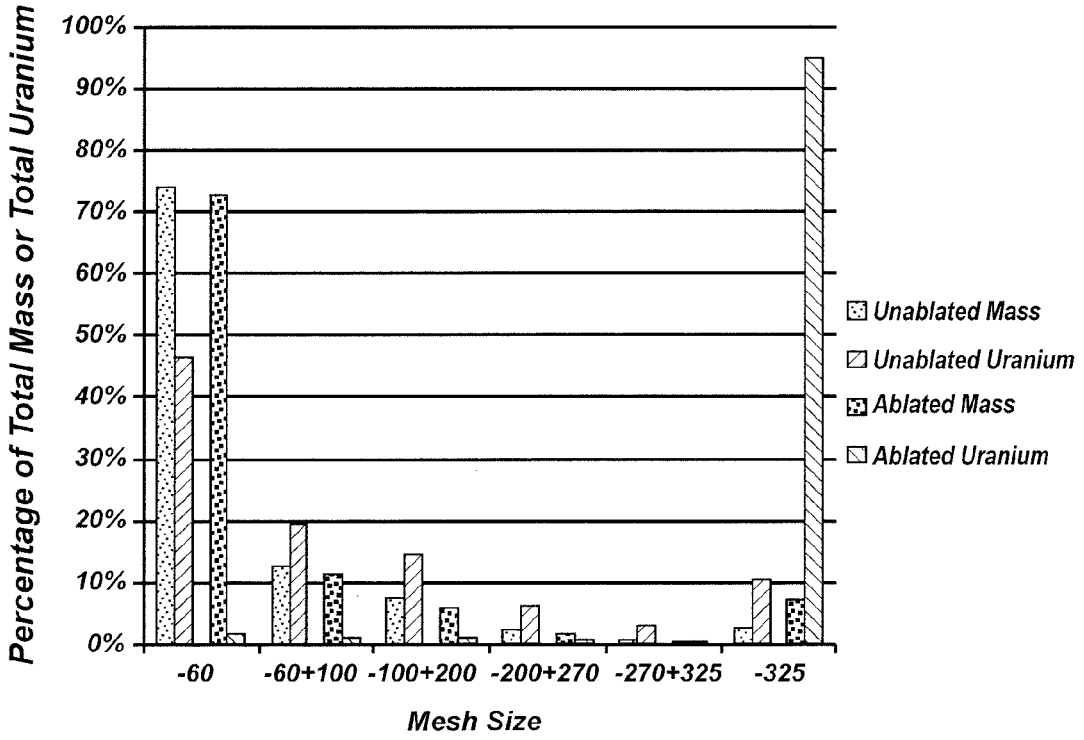
FIG. 20 is a graph illustrating a particle size distribution and a percentage of uranium in each size fraction for a crushed sample of ore from sandstone-hosted uranium deposits and for a sample of the same material after ablation.

The material removed from the ablation system after five minutes was passed through a series of GILSON® screens ranging from 60-mesh to 325-mesh. The sample captured on each screen was dried, weighed, and analyzed by XRF to determine both the mass and uranium balance of each sample. FIG. 20 shows the percentage of total mass and percentage of uranium mass in each size fraction smaller than 0.25 in. (6.35 mm), for both the ablated sample (after five minutes) and an unablated sample. In addition, the clarified post-ablation water was analyzed to determine how much uranium dissolved in the water during ablation.

The difference between the unablated sample and the ablated sample illustrates how ore from sandstone-hosted uranium deposits behaves during ablation. When effectively ablated, the mass of particles of sandstone-hosted uranium ores showed a minor shift from larger to smaller size fractions, whereas the uranium was almost completely concentrated into the minus 325-mesh fraction (see FIG. 20).

Prior to ablation, the plus 60-mesh fraction contained about 74% of the total mass and 46% of the uranium. After ablation, this fraction contained about 73% of the total mass but only 1.8% of the uranium. Before ablation, the minus 325-mesh fraction contained about 3% of the total mass and 10.4% of the uranium. After ablation, this fraction contained about 7% of the total mass and 94.9% of the uranium. It is believed that the increase in mass in the fines and the almost complete transfer of uranium into the minus 325-mesh fraction both occur because, during ablation, the mineralized patina around the grain is removed and pulverized into particles smaller than 325-mesh. The residual uranium in the plus 325-mesh fractions appears to be in fragments of carbonaceous material.

Figure 21:
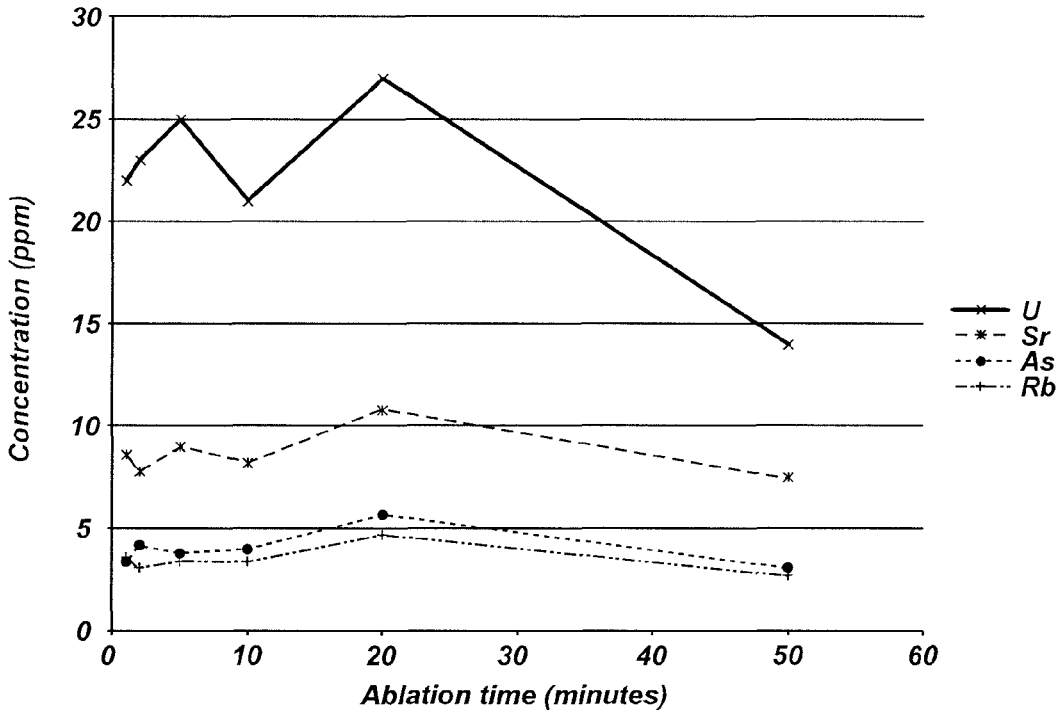
FIGS. 21 and 22 are graphs illustrating concentrations of elements as a function of ablation time in water used in an ablation process according to an embodiment of the present disclosure.
Figure 22:
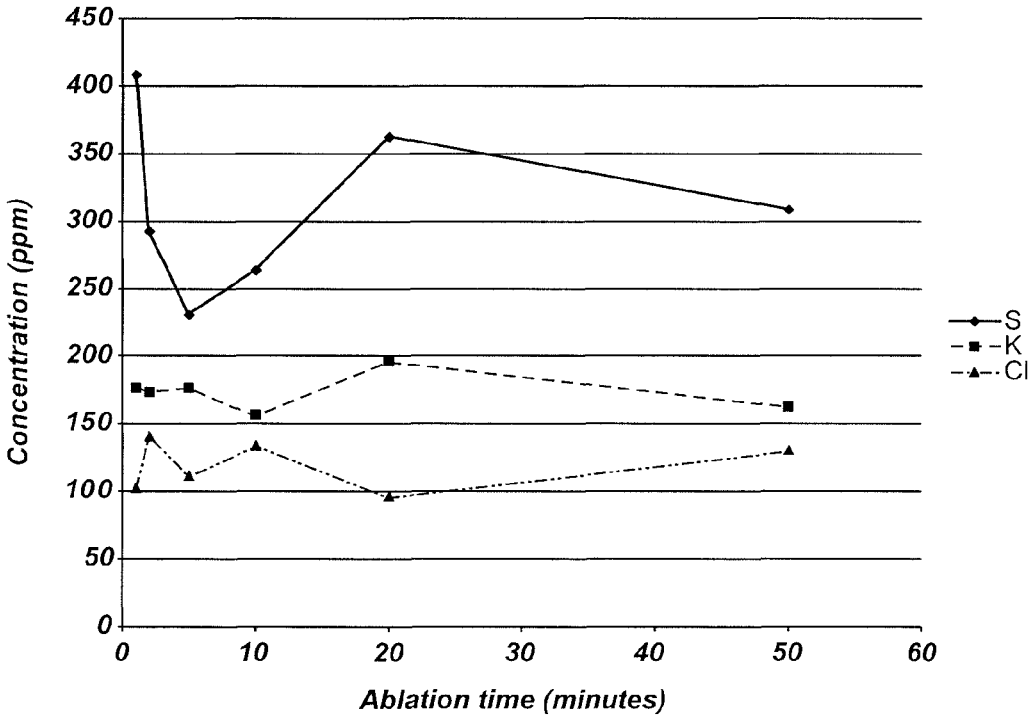

Samples of the clarified ablation water collected at 1, 2, 5, 10, 20 and 50 minutes were analyzed using XRF. FIGS. 21 and 22 collectively show the concentrations of the seven elements detected consistently in the ablation water (As, Cl, K, Rb, S, Sr, and U) as a function of ablation time. The uranium concentration in the ablation solution was 22 ppm after one minute of ablation, which represents 27.9% of the uranium in the head ore. The uranium concentration increased to 25 ppm after five minutes of ablation.

The tests performed on sandstone-hosted uranium ores show that, within five minutes, the ablation process concentrates almost all of the non-solubilized uranium into a very small fraction of the original ore. An average of 95% of the non-solubilized uranium was present in the minus 325-mesh material, which accounted for between 5% and 7% of the mass of the ablated ore. Therefore, after 5 minutes of ablation, if all materials larger than 325-mesh were removed from the post ablation slurry stream, and only the minus 325-mesh post ablated material were subsequently processed, a 95% recovery of the uranium would be possible. Furthermore, subsequent processing could be reduced by between 93% and 95% (corresponding to the 93%-95% of material that need not be further processed). Higher mass reductions and recovery rates can be achieved by elutriating and capturing the light carbonaceous materials that remain in each fraction after ablation. However, even without elutriation, the ablation-only recovery rates compare favorably to conventional mining methods because, although 95% is roughly equivalent to the recovery achieved by leaching, ablation accomplishes this recovery in five minutes, using only culinary water, and does so while reducing by 90% or more the volume of ore that needs to be processed to recover the uranium.

Figure 23:
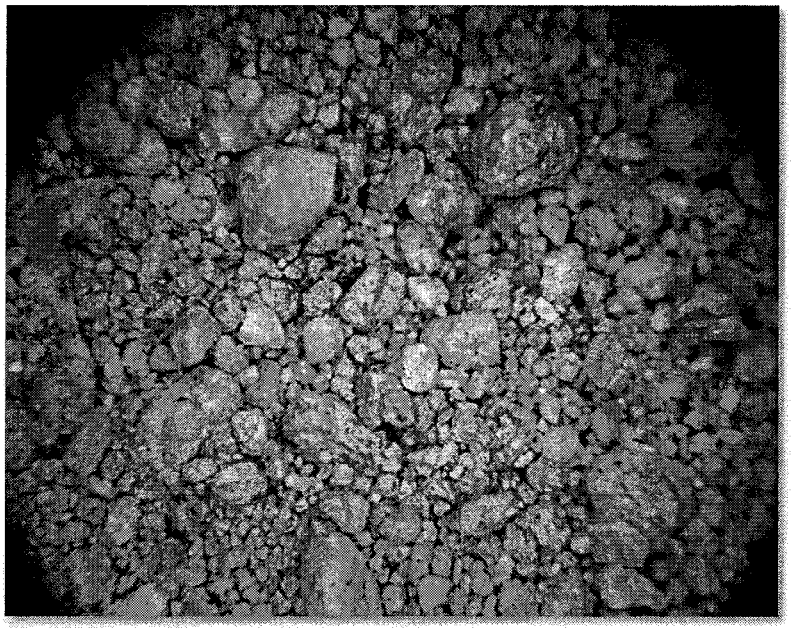
FIG. 23 is a photomicrograph of a crushed ore sample from sandstone-hosted uranium deposits, including a mineral patina.
Figure 24:
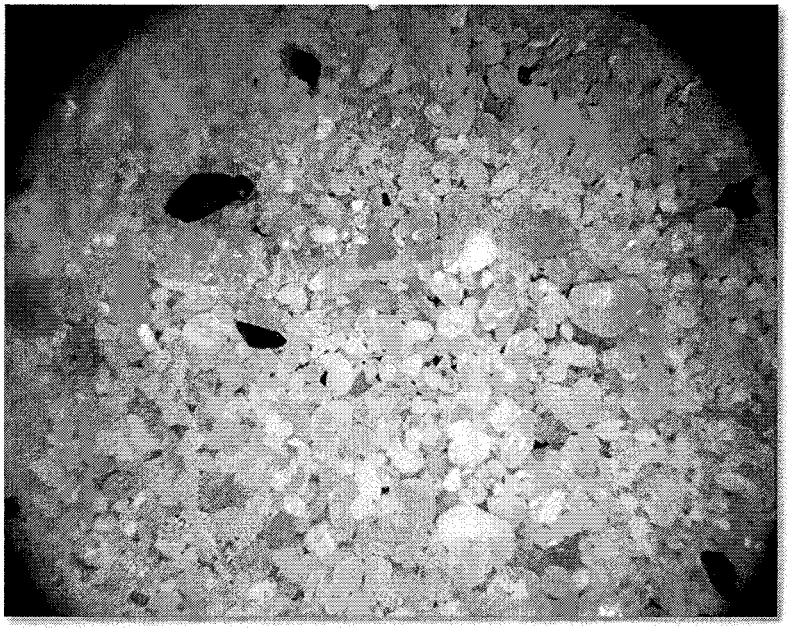
FIG. 24 is a photomicrograph of an ablated crushed ore sample from sandstone-hosted uranium deposits.

Another way to gauge the effectiveness of ablation on sandstone-hosted ores is to visually compare unablated and ablated samples of the same ore. The pre-ablated sample of Example 8 had clearly identifiable grains, but, because of the adhered mineral patina, the underlying grain itself was hidden from view (see FIG. 23). The patina-coated grains had a grayish appearance. In addition, identifiable fragments of the carbonaceous materials were visible, often embedded or partially coated in the mineralized patina. In comparison, the ablated grains were clearly identifiable and free of mineralized patina (see FIG. 24). Ablated fragments of carbonaceous materials were interspersed with these grains.

Example 9: Ablation with Deionized Water

A sample of uranium-bearing sandstone was mechanically crushed and ablated, as described in Example 8. However, deionized water was used as the liquid component of the slurry. The ablation slurry had a distinct silvery appearance that never settled out of the ablation slurry during centrifugation. This supernatant was then filtered through a 0.45-μm filter and analyzed using XRF. No uranium was detected in the filtered ablation water. A portion of the supernatant that had not been filtered was also analyzed using XRF, and found to contain uranium. This suggests that the ablation slurry, before filtering, contained micro-fine uranium material. The micro-fine material appears to be small enough to remain in suspension, and may include other post-depositional elements that would be dissolved into untreated water (e.g., water having dissolved carbonates) if untreated water were used as the slurry fluid.

When sandstone-hosted uranium ores are ablated with untreated water (e.g., culinary water, ground water, etc.), some of the uranium may dissolve into the ablation fluid. The amount dissolved varies depending on the deposit and the water used, but may range from one-tenth to one-third or more of the total uranium in the ore. Without being bound to a particular theory, it is believed that naturally occurring carbonates in the untreated water solubilize some of the uranium from the ore during ablation.

While the disclosure is susceptible to various modifications and alternative forms, specific embodiments have been shown by way of example in the drawings and have been described in detail herein. However, the disclosure is not intended to be limited to the particular forms disclosed. Rather, the disclosure is to cover all modifications, equivalents, and alternatives falling within the scope of the disclosure as defined by the following appended claims and their legal equivalents. In addition, features from one embodiment may be combined with features of another embodiment while still being encompassed within the scope of the present disclosure as contemplated by the inventors. Further, embodiments of the present disclosure have utility in the processing of various types of heterogeneous materials.

What is claimed is:

1. A system for processing a heterogeneous material, comprising:

a conduit for a pressurized fluid; and a nozzle assembly in fluid communication with the conduit, the nozzle assembly comprising a plurality of adjustable nozzles configured such that fluid streams passing through each of the plurality of adjustable nozzles intersect at an oblique angle in a range from about 160° to 179.9° after passing through the plurality of adjustable nozzles, wherein the at least one of the fluid streams comprises a heterogeneous material.

2. The system of claim 1, further comprising a pump configured to deliver the pressurized fluid and particles of the heterogeneous material to the nozzle assembly.

3. The system of claim 2, wherein the nozzle assembly is configured such that an additional fluid stream intersects at least one of the fluid streams at an angle in a range from about 45° to 180°.

4. The system of claim 1, further comprising a splitter configured to divide the heterogeneous material into a plurality of fluid streams, each stream of the plurality in fluid communication with one adjustable nozzle of the plurality.

5. The system of claim 1, wherein the nozzle assembly comprises two adjustable nozzles opposingly oriented over a recovery tank.

6. The system of claim 1, wherein the nozzle assembly comprises an odd number of adjustable nozzles.

7. The system of claim 1, wherein the nozzle assembly comprises a first cylindrical flow channel having a first cross-sectional area and a second cylindrical flow channel having a second, smaller cross-sectional area, wherein the nozzle assembly is configured to pass the heterogeneous material through the first cylindrical flow channel before passing the heterogeneous material through the second cylindrical flow channel.

8. The system of claim 7, wherein the nozzle assembly comprises a third cylindrical flow channel having a third cross-sectional area, the third cross-sectional area smaller than the second, smaller cross-sectional area, wherein the nozzle assembly is configured to pass the heterogeneous material through the second cylindrical flow channel before passing the heterogeneous material through the third cylindrical flow channel.

9. The system of claim 1, wherein the nozzle assembly comprises a non-brittle hard material disposed over at least one surface of each nozzle of the plurality of adjustable nozzles.

10. A method of processing a heterogeneous material, comprising: entraining heterogeneous particles of a material into at least one fluid stream; passing the at least one fluid stream through an adjustable nozzle; impacting the at least one fluid stream with another fluid stream at an oblique angle in a range from about 160° to 179.9° to ablate the heterogeneous particles of the material; and classifying the heterogeneous particles.

11. The method of claim 10, wherein entraining heterogeneous particles into at least one fluid stream comprises mixing the heterogeneous particles with a fluid.

12. The method of claim 10, wherein impacting the at least one fluid stream with another fluid stream at an oblique angle comprises impacting at least one of the fluid streams with an additional fluid stream at an angle in a range from about 45° to 180°.

13. The method of claim 10, wherein impacting the at least one fluid stream with another fluid stream at an oblique angle comprises colliding heterogeneous particles entrained in the at least one fluid stream with heterogeneous particles entrained in the another fluid stream.

14. The method of claim 10, wherein classifying the heterogeneous particles comprises classifying the heterogeneous particles based on particle size.

15. The method of claim 10, wherein entraining heterogeneous particles into at least one fluid stream comprises mixing uranium ore with water.

16. The method of claim 10, wherein entraining heterogeneous particles into at least one fluid stream comprises entraining the heterogeneous particles in water substantially free of a reagent.

17. The method of claim 10, wherein entraining heterogeneous particles into at least one fluid stream comprises entraining heterogeneous particles in an odd number of fluid streams.

18. The method of claim 10, wherein impacting the at least one fluid stream with another fluid stream at an oblique angle to ablate the heterogeneous particles of the material comprises dissociating constituents of the heterogeneous particles.

19. The method of claim 18, wherein dissociating constituents of the heterogeneous particles comprises forming a first fraction of particles and a second fraction of particles, the particles of the first fraction having a first average density, and the particles of the second fraction having a second average density different from the first average density.

20. The method of claim 19, wherein the first fraction of particles has a first average particle size and the second fraction of particles has a second average particle size different from the first average particle size.

21. The method of claim 10, further comprising recycling the ablated heterogeneous particles of the material in the at least one fluid stream through the adjustable nozzle.

* * * * *